US011188022B2

(12) United States Patent
Kato et al.

(10) Patent No.: US 11,188,022 B2
(45) Date of Patent: Nov. 30, 2021

(54) PROCESS CARTRIDGE AND IMAGE FORMING APPARATUS

(71) Applicant: BROTHER KOGYO KABUSHIKI KAISHA, Nagoya (JP)

(72) Inventors: Yasutada Kato, Nagoya (JP); Shougo Sato, Seto (JP)

(73) Assignee: BROTHER KOGYO KABUSH1KI KAISHA, Nagoya (JP)

( * ) Notice: Subject to any disclaimer, the term of this patent is extended or adjusted under 35 U.S.C. 154(b) by 0 days.

(21) Appl. No.: 17/146,891

(22) Filed: Jan. 12, 2021

(65) Prior Publication Data

US 2021/0232088 A1 Jul. 29, 2021

(30) Foreign Application Priority Data

Jan. 29, 2020 (JP) ..... JP2020-013018

(51) Int. Cl.

| | |
|---|---|
| ***G03G 21/16*** | (2006.01) |
| ***G03G 21/18*** | (2006.01) |
| ***G03G 15/08*** | (2006.01) |
| ***G03G 15/00*** | (2006.01) |

(52) U.S. Cl.

CPC ..... *G03G 21/1814* (2013.01); *G03G 15/0865* (2013.01); *G03G 15/0877* (2013.01); *G03G 15/751* (2013.01)

(58) Field of Classification Search

CPC ..... G03G 15/0865; G03G 15/0877; G03G 15/751; G03G 21/1814

See application file for complete search history.

(56) References Cited

U.S. PATENT DOCUMENTS

| | | | | |
|---|---|---|---|---|
| 2010/0215395 | A1 | 8/2010 | Funada et al. | |
| 2010/0215407 | A1 | 8/2010 | Funada et al. | |
| 2010/0221045 | A1 | 9/2010 | Hattori et al. | |
| 2012/0020699 | A1 | 1/2012 | Kamimura | |
| 2014/0050502 | A1 | 2/2014 | Tsuritani et al. | |
| 2017/0139372 | A1* | 5/2017 | Kashiide | G03G 15/0886 |
| 2019/0219948 | A1* | 7/2019 | Kimura | G03G 15/08 |

FOREIGN PATENT DOCUMENTS

| | | | |
|---|---|---|---|
| JP | 8-030082 | A | 2/1996 |
| JP | 2000-242072 | A | 9/2000 |
| JP | 2010-197869 | A | 9/2010 |
| JP | 2012-027235 | A | 2/2012 |
| JP | 2014-025991 | A | 2/2014 |
| JP | 2014-038242 | A | 2/2014 |
| JP | 2016-12144 | A | 1/2016 |

* cited by examiner

*Primary Examiner* — Hoang X Ngo
(74) *Attorney, Agent, or Firm* — Merchant & Gould P.C.

(57) ABSTRACT

A process cartridge includes: a toner cartridge including: a toner housing accommodating toner and having a toner discharge hole; and a toner shutter movable between a closed position closing the toner discharge hole and an opened position opening the toner discharge hole with respect to the toner discharge hole; and a drum cartridge including: a photosensitive drum rotatable about a drum axis extending in a first direction; and a drum frame supporting the photosensitive drum, wherein in a state the toner cartridge is mounted to the drum cartridge, the toner housing is rotatable about an axis between a first position in which the toner shutter is located in the closed position and a second position in which the toner shutter is located in the opened position, the axis extending in a second direction intersecting with the first direction.

16 Claims, 18 Drawing Sheets

PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2020-013018 filed on Jan. 29, 2020, the contents of which are incorporated herein by reference.

TECHNICAL FIELD

The present disclosure relates to a process cartridge and an image forming apparatus.

BACKGROUND

In the related art, an image forming apparatus includes a plurality of process cartridges. Each of the plurality of process cartridges includes a drum cartridge having a photosensitive drum, and a toner cartridge that can be mounted to the drum cartridge. The plurality of process cartridges is aligned in a direction intersecting with axes of the photosensitive drums.

The toner cartridge has a toner housing with a toner discharge hole, and a toner shutter. The toner shutter is configured to open/close the toner discharge hole.

In a state where the toner cartridge is mounted to the drum cartridge, the toner housing can rotate about an axis extending in the same direction as the axis of the photosensitive drum between a first position in which the toner shutter is located in a closed position and a second position in which the toner shutter is located in an opened position.

SUMMARY

One illustrative aspect of the present disclosure provides a process cartridge including: a toner cartridge including: a toner housing configured to accommodate toner, the toner housing having a toner discharge hole for discharging the toner; and a toner shutter movable between a closed position and an opened position with respect to the toner discharge hole, the toner discharge hole being closed in a case the toner shutter is located in the closed position, the toner discharge hole being opened in a case the toner shutter is located in the opened position; and a drum cartridge including: a photosensitive drum rotatable about a drum axis extending in a first direction; and a drum frame configured to support the photosensitive drum, the toner cartridge being mountable to the drum cartridge, wherein in a state the toner cartridge is mounted to the drum cartridge, the toner housing is rotatable about an axis between a first position and a second position, the axis extending in a second direction intersecting with the first direction, the toner shutter being located in the closed position in a case the toner housing is located in the first position, the toner shutter being located in the opened position in a case the toner housing is located in the second position.

According to the process cartridge and the image forming apparatus of the present disclosure, it is possible to increase the size of the toner cartridge.

BRIEF DESCRIPTION OF DRAWINGS

Illustrative embodiments of the disclosure will be described in detail based on the following figures, wherein.

DETAILED DESCRIPTION

In the above-described related-art process cartridge, the toner housing is configured to rotate about the axis extending in the same direction as the axis of the photosensitive drum between the first position and the second position.

For this reason, it is necessary to secure a space for rotating the toner housing in the direction intersecting with the axis of the photosensitive drum, which makes it difficult to increase a size of the toner cartridge in the direction intersecting with the axis of the photosensitive drum.

Therefore, illustrative aspects of the present disclosure provide a process cartridge and an image forming apparatus capable of increasing a size of a toner cartridge.

1. Image Forming Apparatus 1

An outline of an image forming apparatus 1 of a first illustrative embodiment is described with reference to FIGS. 1 and 2.

Figure 1:
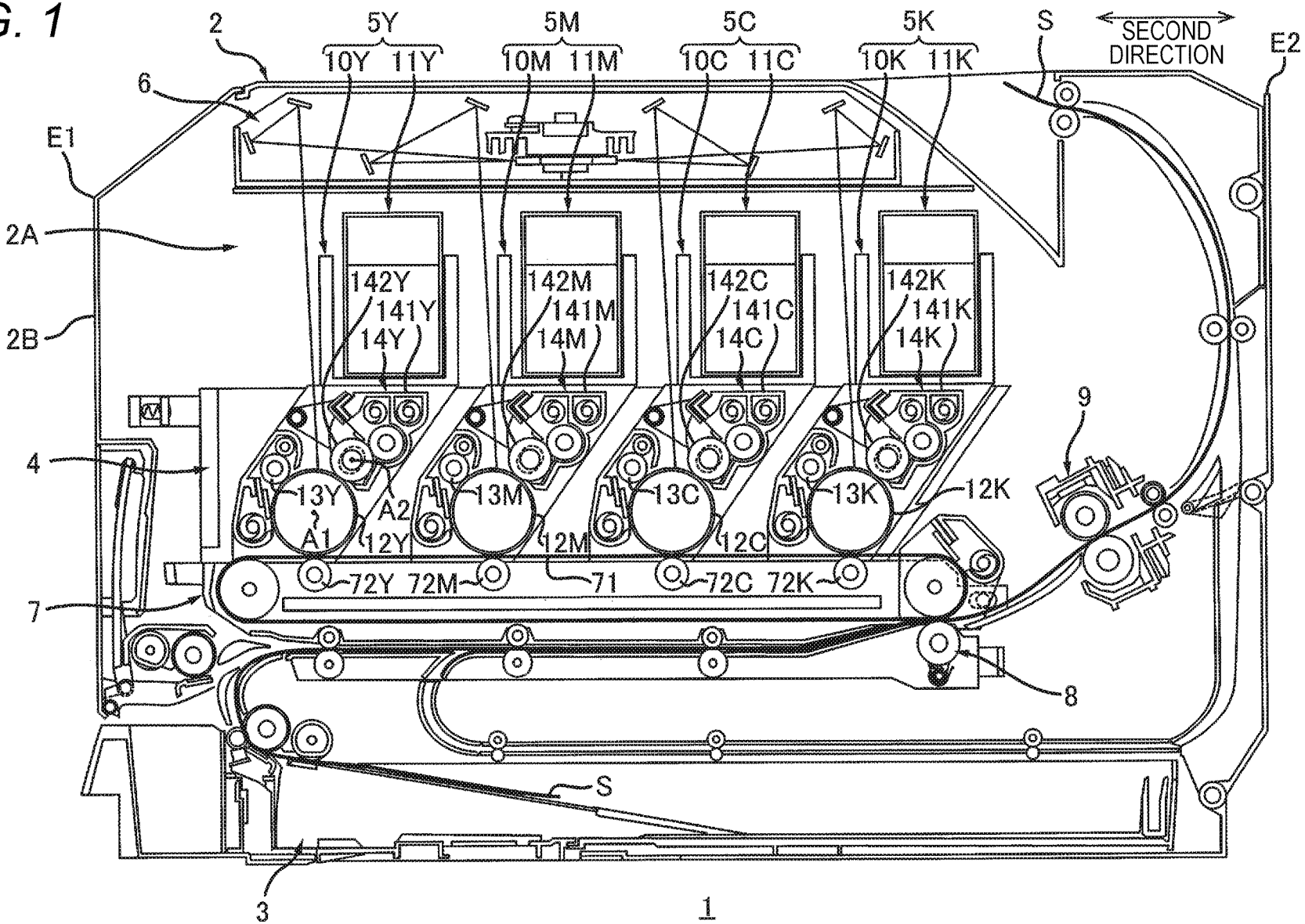
FIG. 1 is a schematic configuration view of an image forming apparatus of a first illustrative embodiment.

As shown in FIG. 1, the image forming apparatus 1 includes a main body housing 2, a sheet cassette 3, a drawer 4, four process cartridges 5Y, 5M, 5C and 5K, an exposure device 6, a belt unit 7, a transfer roller 8, and a fixing device 9.

In descriptions below, a direction in which a drum axis A1 extends in a state where the process cartridge 5Y is mounted to the main body housing 2 is defined as a first direction. The drum axis A1 will be described later.

1.1 Main Body Housing 2

In the main body housing 2, the sheet cassette 3, the drawer 4, the four process cartridges 5Y, 5M, 5C and 5K, the exposure device 6, the belt unit 7, the transfer roller 8, and the fixing device 9 are accommodated.

The main body housing 2 has a first end portion E1 and a second end portion E2 in a second direction. The second end portion E2 is located distant from the first end portion E1 in the second direction. The second direction intersects with the first direction. Preferably, the second direction is orthogonal to the first direction.

Figure 2:
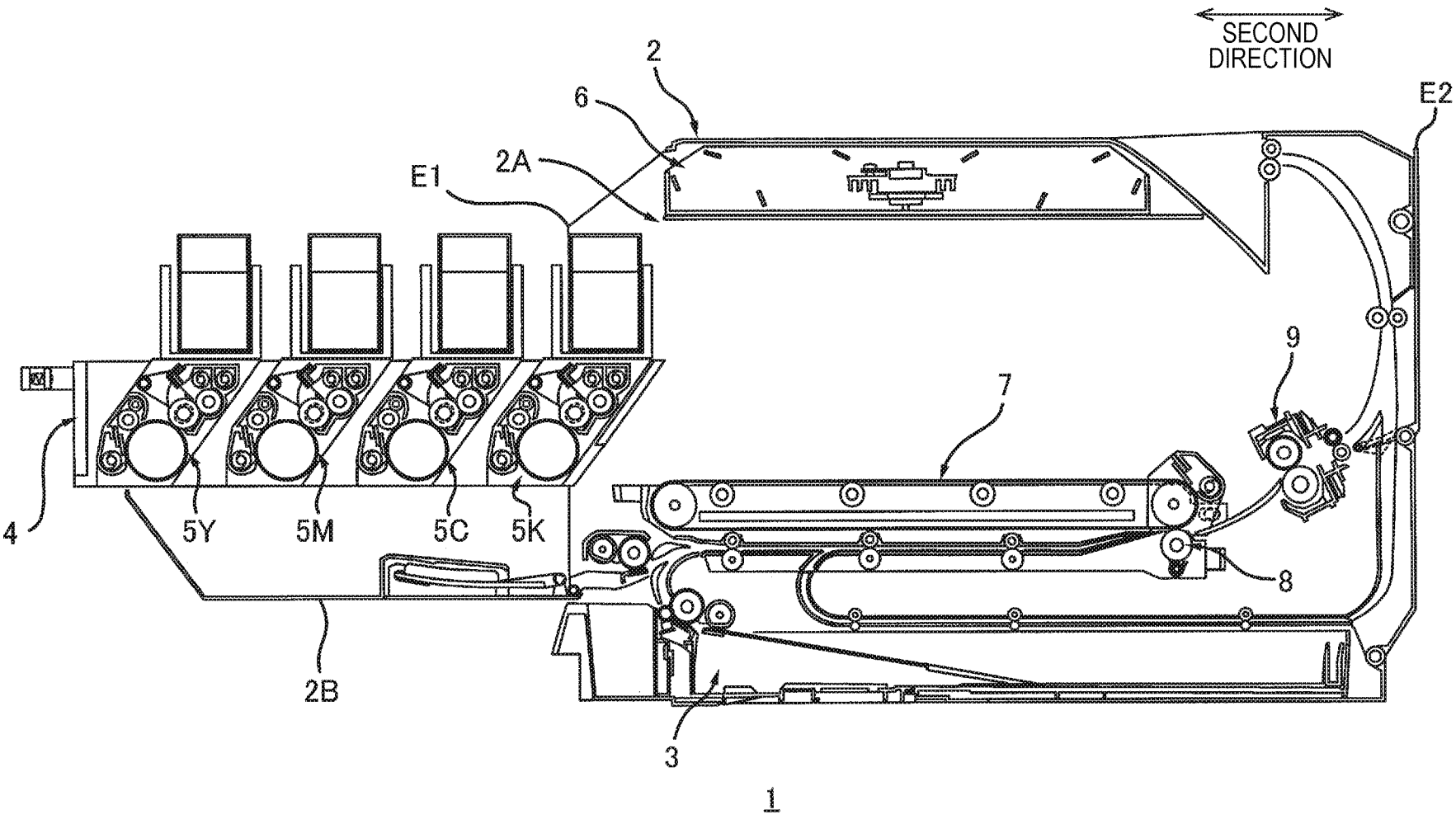
FIG. 2 illustrates movement of a drawer shown in FIG. 1, depicting a state where a cover is located in a cover-opened position and the drawer is located in an outer position.

As shown in FIG. 2, the main body housing 2 has an opening 2A. The main body housing 2 has a cover 2B.

The opening 2A is located at the first end portion E1.

The cover 2B can move between a cover-closed position (refer to FIG. 1) and a cover-opened position (refer to FIG. 2). When the cover 2B is located in the cover-closed position, the cover 2B closes the opening 2A. When the cover 2B is located in the cover-opened position, the opening 2A is opened.

1.2 Sheet Cassette 3

As shown in FIG. 1, the sheet cassette 3 can accommodate sheets S. The sheet S in the sheet cassette 3 is conveyed toward the transfer roller 8.

1.3 Drawer 4

As shown in FIG. 2, in a state where the cover 2B is located in the cover-opened position, the drawer 4 can move in the second direction between an inner position (refer to FIG. 1) and an outer position (refer to FIG. 2) through the opening 2A. As shown in FIG. 1, in a state where the drawer 4 is located in the inner position, the drawer 4 is entirely located inside of the main body housing 2. As shown in FIG. 2, in a state where the drawer 4 is located in the outer position, at least a part of the drawer 4 is located outside of the main body housing 2. The drawer 4 is configured to support the four process cartridges 5Y, 5M, 5C and 5K.

1.4 Process Cartridge 5Y

As shown in FIG. 1, the process cartridge 5Y can be mounted to the main body housing 2. Specifically, in a state where the process cartridge 5Y is supported to the drawer 4 and the drawer 4 is located in the inner position, the process cartridge 5Y is mounted to the main body housing 2. Note that, as shown in FIG. 2, in a state where the process cartridge 5Y is supported to the drawer 4 and the drawer 4 is located in the outer position, the process cartridge 5Y can be removed from the drawer 4.

As shown in FIG. 1, the process cartridge 5Y includes a drum cartridge 10Y, and a toner cartridge 11Y.

1.4.1 Drum Cartridge 10Y

The drum cartridge 10Y includes a photosensitive drum 12Y, a charging device 13Y, and a developing device 14Y.

1.4.1.1 Photosensitive Drum 12Y

The photosensitive drum 12Y extends in the first direction. The photosensitive drum 12Y has a cylindrical shape. The photosensitive drum 12Y can rotate about the drum axis A1. The drum axis A1 extends in the first direction.

1.4.1.2 Charging Device 13Y

The charging device 13Y is configured to charge a circumferential surface of the photosensitive drum 12Y. In the present illustrative embodiment, the charging device 13Y is a charging roller. The charging device 13Y may also be a scorotron-type charger.

1.4.1.3 Developing Device 14Y

The developing device 14Y can supply toner to the photosensitive drum 12Y. Specifically, the developing device 14Y includes a developing housing 141Y, and a developing roller 142Y.

The developing housing 141Y can accommodate the toner supplied from the toner cartridge 11Y. The developing housing 141Y is configured to support the developing roller 142Y.

The developing roller 142Y can supply the toner in the developing housing 141Y to the photosensitive drum 12Y. The developing roller 142Y is in contact with the photosensitive drum 12Y. Note that, the developing roller 142Y may be configured to be separable from the photosensitive drum 12Y. The developing roller 142Y extends in the first direction. The developing roller 142Y can rotate about a developing axis A2. The developing axis A2 extends in the first direction.

1.4.2 Toner Cartridge 11Y

The toner cartridge 11Y can be mounted to the drum cartridge 10Y. The toner cartridge 11Y mounted to the drum cartridge 10Y can be removed from the drum cartridge 10Y. The toner cartridge 11Y is configured to accommodate the toner. In a state where the toner cartridge 11Y is mounted to the drum cartridge 10*y*, the toner cartridge 11Y can supply the toner to the developing device 14Y.

1.5 Process Cartridges 5M, 5C and 5K

The process cartridges 5M, 5C and 5K are in alignment with the process cartridge 5Y in the second direction. The process cartridges 5M, 5C and 5K can be mounted to the main body housing 2. Specifically, in a state where the process cartridges 5M, 5C and 5K are supported to the drawer 4 and the drawer 4 is located in the inner position, the process cartridges 5M, 5C and 5K are mounted to the main body housing 2. As shown in FIG. 2, in a state where the process cartridges 5M, 5C and 5K are supported to the drawer 4 and the drawer 4 is located in the outer position, each of the process cartridges 5M, 5C and 5K can be removed from the drawer 4.

Note that, each of the process cartridges 5M, 5C and 5K is described in a similar manner to the process cartridge 5Y. For this reason, the descriptions of each of the process cartridges 5M, 5C and 5K are omitted.

1.6 Exposure Device 6

As shown in FIG. 1, in a state where the process cartridges 5Y, 5M, 5C and 5K are mounted to the drawer 4 and the drawer 4 is located in the inner position, the exposure device 6 can expose the circumferential surfaces of the photosensitive drums 12Y, 12M, 12C and 12K. In the present illustrative embodiment, the exposure device 6 is a laser scan unit.

1.7 Belt Unit 7

In the state where the process cartridges 5Y, 5M, 5C and 5K are mounted to the drawer 4 and the drawer 4 is located in the inner position, the belt unit 7 is located below the process cartridges 5Y, 5M, 5C and 5K. The belt unit 7 includes a belt 71, and transfer rollers 72Y, 72M, 72C and 72K. In other words, the image forming apparatus 1 includes the belt 71.

The belt 71 is an intermediate transfer belt. In the state where the process cartridges 5Y, 5M, 5C and 5K are mounted to the drawer 4 and the drawer 4 is located in the inner position, the belt 71 is in contact with the photosensitive drums 12Y, 12M, 12C and 12K.

The transfer roller 72Y is configured to transfer the toner on the photosensitive drum 12Y to the belt 71. The transfer roller 72M is configured to transfer the toner on the photosensitive drum 12M to the belt 71. The transfer roller 72C is configured to transfer the toner on the photosensitive drum 12C to the belt 71. The transfer roller 72K is configured to transfer the toner on the photosensitive drum 12K to the belt 71.

1.8 Transfer Roller 8

The transfer roller 8 is configured to transfer the toner on the belt 71 to the sheet S. Specifically, the sheet S conveyed from the sheet cassette 3 toward the transfer roller 8 passes between the transfer roller 8 and the belt 71 and is then conveyed to the fixing device 9. At this time, the transfer roller 8 is configured to transfer the toner on the belt 71 to the sheet S.

1.9 Fixing Device 9

The fixing device 9 is configured to heat and pressurize the sheet S having the toner transferred thereon, thereby fixing the toner on the sheet S. The sheet S that passes through the fixing device 9 is discharged onto an upper surface of the main body housing 2.

2. Details of Drum Cartridge 10Y

Figure 3:
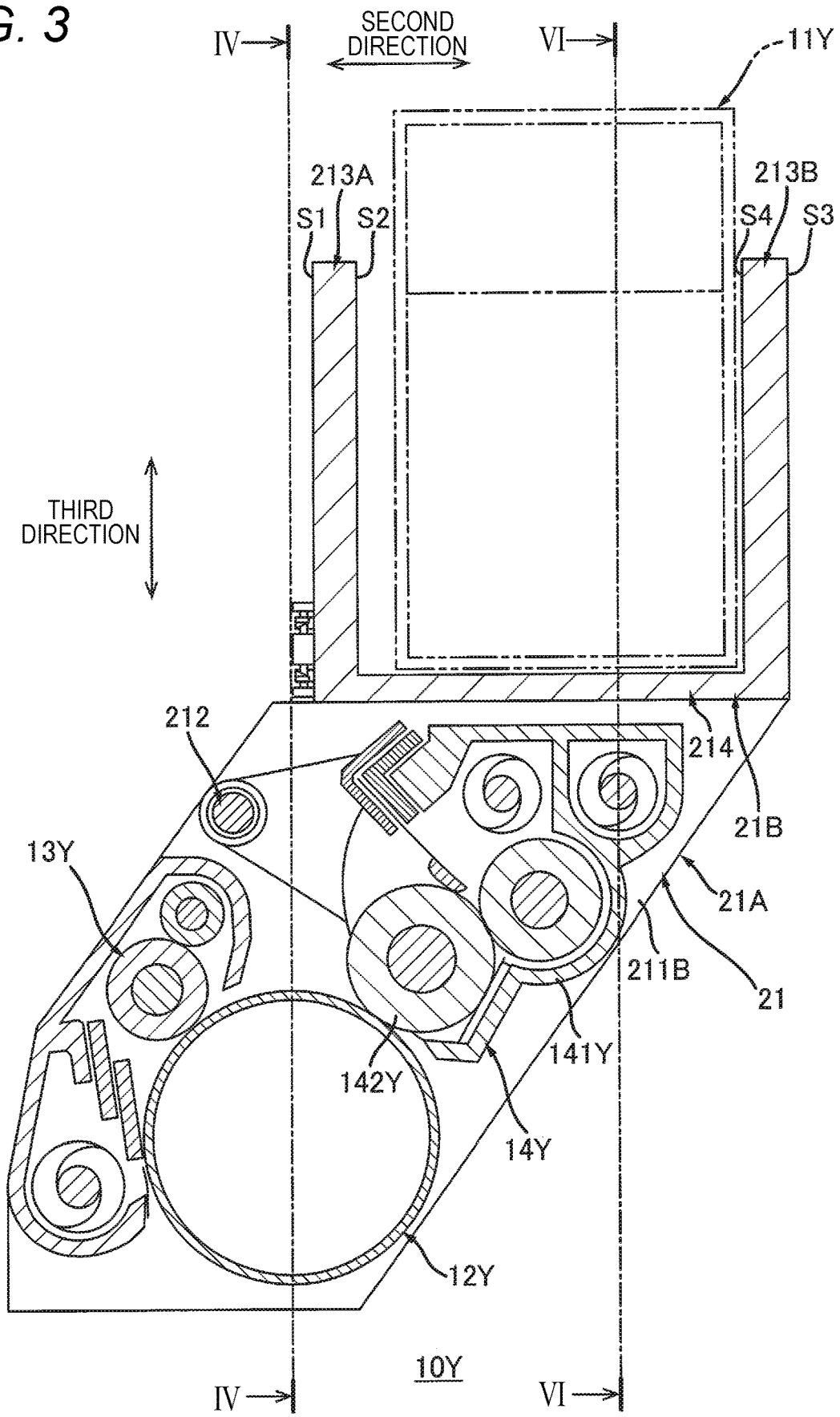
FIG. 3 is a sectional view of a drum cartridge at a center in a first direction.
Figure 4:
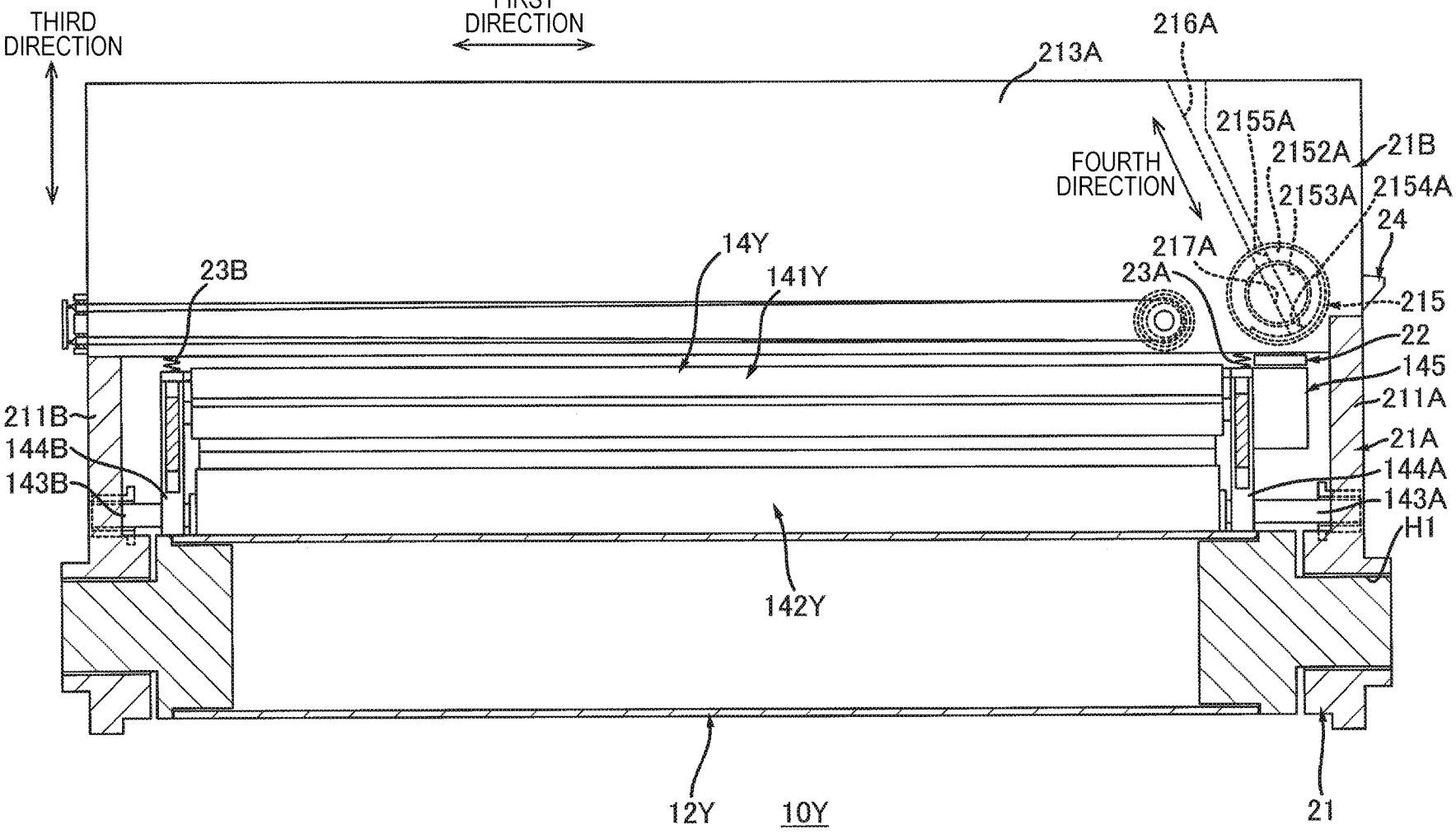
FIG. 4 is a IV-IV sectional view of the drum cartridge shown in FIG. 3.

As shown in FIGS. 3 and 4, the drum cartridge 10Y includes a drum frame 21, a seal member 22 (refer to FIG. 4), two springs 23A and 23B (refer to FIG. 4), and a stopper 24 (refer to FIG. 4), in addition to the photosensitive drum 12Y, the charging device 13Y and the developing device 14Y 2.1 Drum Frame 21

The drum frame 21 has a drum support part 21A, and a toner cartridge support part 21B.

2.1.1 Drum Support Part 21A

The drum support part 21A is configured to support the photosensitive drum 12Y, the charging device 13Y and the developing device 14Y. In other words, the drum frame 21 is configured to support the photosensitive drum 12Y, the charging device 13Y and the developing device 14Y. The drum support part 21A includes drum side plates 211A and 211B (refer to FIG. 4), and a shaft 212 (refer to FIG. 3).

2.1.1.1 Drum Side Plate 211A

As shown in FIG. 4, the drum side plate 211A is located at one end portion of the drum cartridge 10Y in the first direction. The drum side plate 211A extends in a third direction. The third direction intersects with both the first direction and the second direction. Preferably, the third direction are orthogonal to both the first direction and the second direction.

Figure 5:
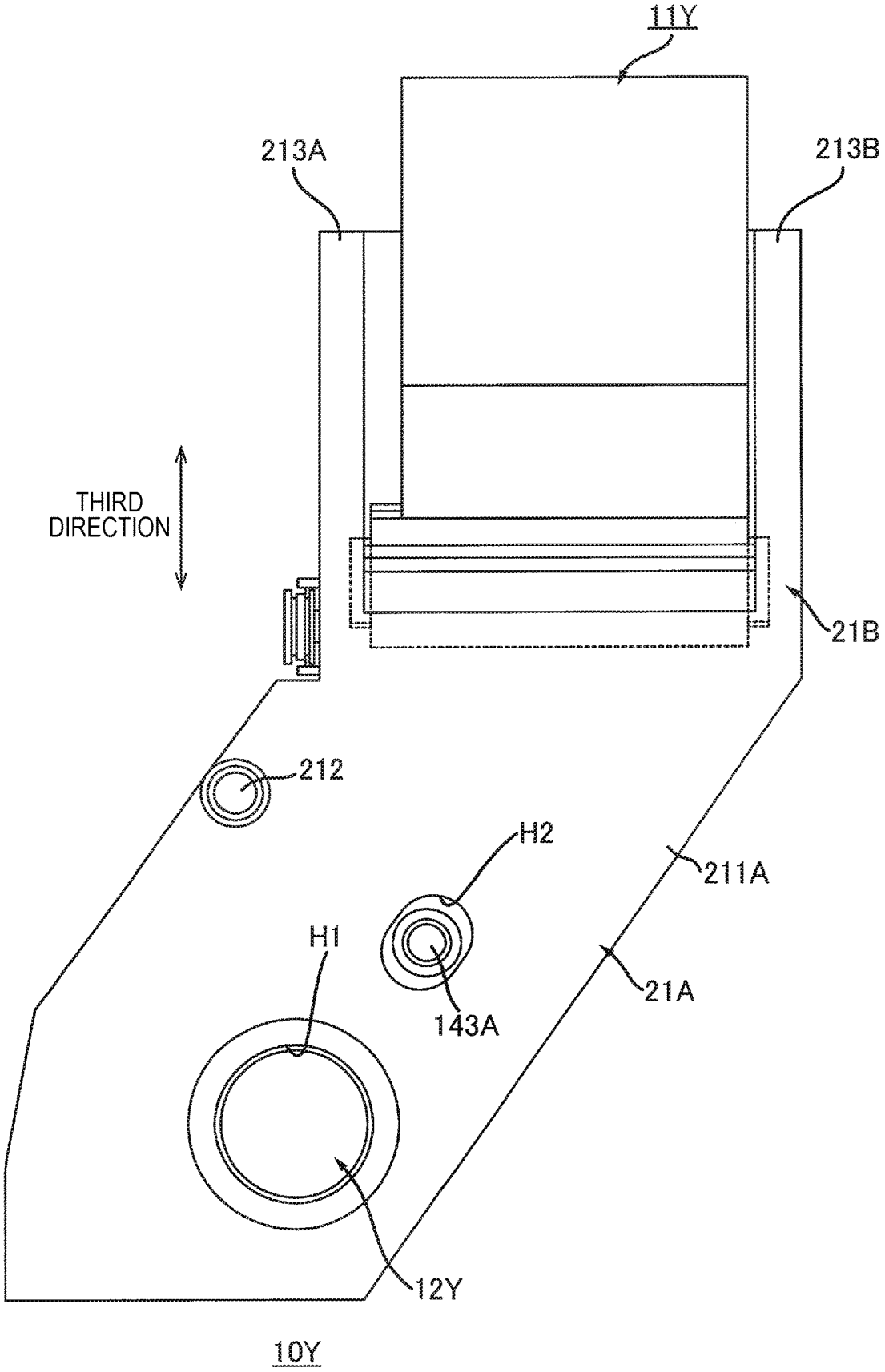
FIG. 5 is a side view of the drum cartridge shown in FIG. 4, as seen from one side in the first direction.

As shown in FIG. 5, the drum side plate 211A has a hole H1, and a hole H2.

In the hole H1, one end portion of the photosensitive drum 12Y in the first direction is rotatably fitted. The hole H1 has a circular shape.

The hole H2 is located distant from the hole H1. The hole H2 is located between the hole H1 and the toner cartridge support part 21B in the third direction. The hole H2 is a long hole.

2.1.1.2 Drum Side Plate 211B

As shown in FIG. 4, the drum side plate 211B is located at the other end portion of the drum cartridge 10Y in the first direction. The drum side plate 211B is located distant from the drum side plate 211A in the first direction. The drum side plate 211B is configured to support the other end portion of the photosensitive drum 12Y in the first direction.

The drum side plate 211B is described in a similar manner to the drum side plate 211A. For this reason, the descriptions of the drum side plate 211B are omitted.

2.1.1.3 Shaft 212

As shown in FIGS. 3 and 5, the shaft 212 extends in the first direction. The shaft 212 has a circular column shape. One end portion of the shaft 212 in the first direction is supported to the drum side plate 211A. The other end portion of the shaft 212 in the first direction is supported to the drum side plate 211B. The developing device 14Y is rotatably attached to the shaft 212.

2.1.2 Toner Cartridge Support Part 21B

As shown in FIG. 4, the toner cartridge support part 21B is located on one side of the drum support part 21A in the third direction. The toner cartridge support part 21B is located on one side of the developing device 14Y in the third direction. The toner cartridge support part 21B is located on an opposite side to the photosensitive drum 12Y with respect to the developing device 14Y in the third direction. The toner cartridge support part 21B extends in the first direction. One end portion of the toner cartridge support part 21B in the first direction is connected to the drum side plate 211A. The other end portion of the toner cartridge support part 21B in the first direction is connected to the drum side plate 211B.

As shown in FIG. 3, in the state where the toner cartridge 11Y is mounted to the drum cartridge 10Y, the toner cartridge support part 21B supports the toner cartridge 11Y. The toner cartridge support part 21B has side plates 213A and 213B, a bottom plate 214, and a shutter 215 (refer to FIG. 4).

2.1.2.1 Side Plate 213A

The side plate 213A is located at one end portion of the toner cartridge support part 21B in the second direction. In the state where the toner cartridge 11Y is mounted to the drum cartridge 10Y, the side plate 213A faces the toner cartridge 11Y in the second direction. The side plate 213A extends in the first direction (refer to FIG. 4) and the third direction. The side plate 213A has a surface S1 and a surface S2 in the second direction. The surface S2 is located between the surface S1 and the side plate 213B in the second direction. In the state where the toner cartridge 11Y is mounted to the drum cartridge 10Y, the surface S2 faces the toner cartridge 11Y in the second direction.

As shown in FIG. 4, the side plate 213A has a toner cartridge guide 216A, and a groove 217A.

The toner cartridge guide 216A is located on the surface S2 of the side plate 213A (refer to FIG. 3). The toner cartridge guide 216A extends in a fourth direction. The fourth direction is inclined relative to the third direction. The fourth direction intersects with all of the first direction, the second direction and the third direction. Preferably, the fourth direction is orthogonal to the second direction, and intersects with the first direction and the third direction. When mounting the toner cartridge 11Y to the drum cartridge 10Y, the toner cartridge guide 216A guides one end portion of the toner cartridge 11Y in the second direction.

The groove 217A is located distant from the toner cartridge guide 216A in the fourth direction. The groove 217A is located between the toner cartridge guide 216A and the bottom plate 214 (refer to FIG. 6A) in the fourth direction. The groove 217A extends in the fourth direction.

2.1.2.2 Side Plate 213B

As shown in FIG. 3, the side plate 213B is located at the other end portion of the toner cartridge support part 21B in the second direction. The side plate 213B is located distant from the side plate 213A in the second direction. In the state where the toner cartridge 11Y is mounted to the drum cartridge 10Y, the side plate 213B is located on an opposite side to the side plate 213A with respect to the toner cartridge 11Y in the second direction. In the state where the toner cartridge 11Y is mounted to the drum cartridge 10Y, the side plate 213B faces the toner cartridge 11Y in the second direction. The side plate 213B extends in the first direction (refer to FIG. 6A) and the third direction. The side plate 213B has a surface S3 and a surface S4 in the second direction. The surface S4 is located between the surface S3 and the side plate 213A in the second direction. In the state where the toner cartridge 11Y is mounted to the drum cartridge 10Y, the surface S4 faces the toner cartridge 11Y in the second direction.

Figure 6A:
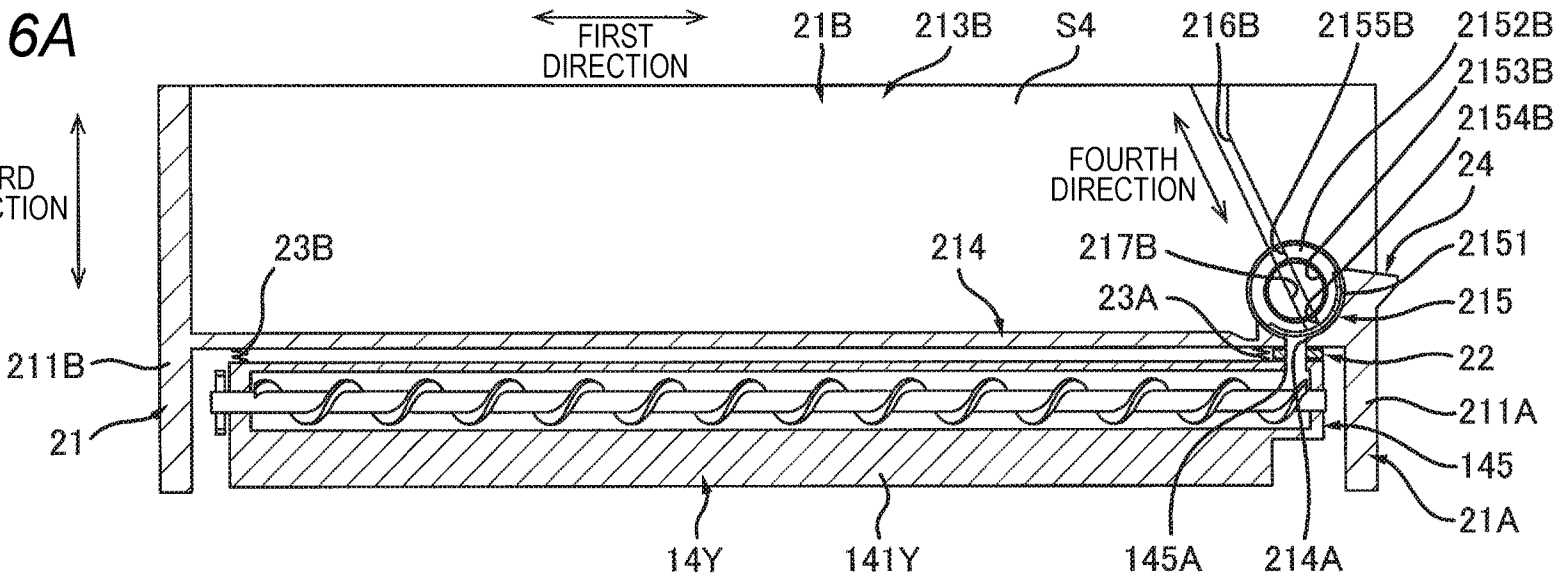
FIG. 6A is a VI-VI sectional view of the drum cartridge shown in FIG. 3.

As shown in FIG. 6A, the side plate 213B has a toner cartridge guide 216B, and a groove 217B.

The toner cartridge guide 216B is located on the surface S4 (refer to FIG. 3) of the side plate 213B. The toner cartridge guide 216B extends in the fourth direction. When mounting the toner cartridge 11Y to the drum cartridge 10Y, the toner cartridge guide 216B guides the other end portion of the toner cartridge 11Y in the second direction.

The groove 217B is located distant from the toner cartridge guide 216B in the fourth direction. The groove 217B is located between the toner cartridge guide 216B and the bottom plate 214 in the fourth direction. The groove 217B extends in the fourth direction.

2.1.2.3 Bottom Plate 214

As shown in FIGS. 3 and 6A, the bottom plate 214 extends in the first direction and the second direction. As shown in FIG. 3, the bottom plate 214 is located between the side plate 213A and the side plate 213B in the second direction. One end portion of the bottom plate 214 in the second direction is connected to the side plate 213A. The other end portion of the bottom plate 214 in the second direction is connected to the side plate 213B. Also, as shown in FIG. 6A, the bottom plate 214 is located between the drum side plate 211A and the drum side plate 211B in the first direction. One end portion of the bottom plate 214 in the first direction is connected to the drum side plate 211A. The other end portion of the bottom plate 214 in the first direction is connected to the drum side plate 211B.

The bottom plate 214 has a toner receiving hole 214A. In other words, the toner cartridge support part 21B has the toner receiving hole 214A. In other words, the drum frame 21 has the toner receiving hole 214A. In other words, the drum cartridge 10Y has the toner receiving hole 214A. The toner receiving hole 214A is located at one end portion of the bottom plate 214 in the first direction.

Figure 7:
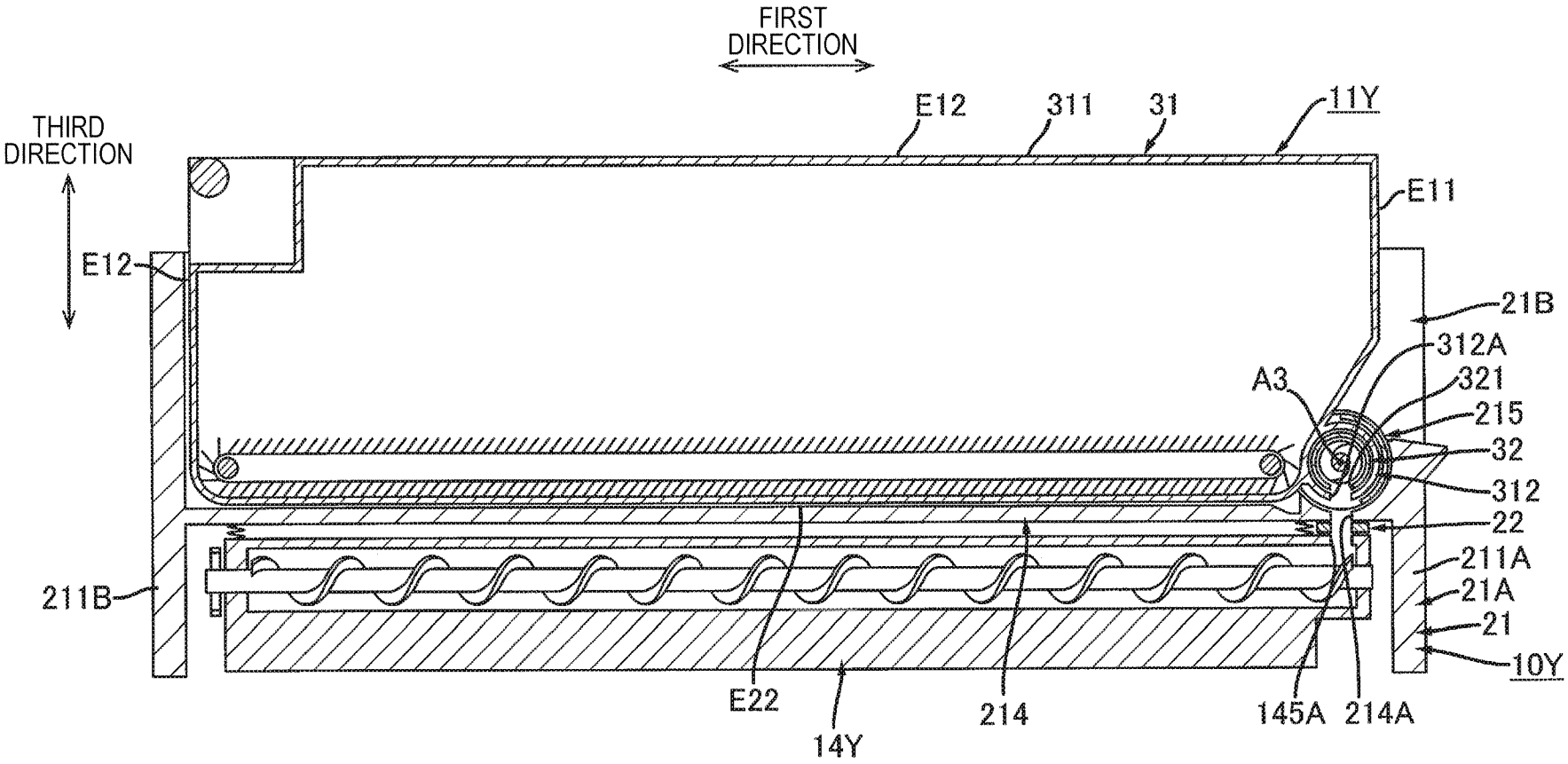
FIG. 7 is a sectional view of a process cartridge taken along a VI-VI line of FIG. 3, depicting a state where a toner cartridge is mounted to the drum cartridge and a toner housing is located in a second position.

As shown in FIG. 7, in the state where the toner cartridge 11Y is mounted to the drum cartridge 10Y, the toner receiving hole 214A communicates with the toner discharge hole 312A of the toner cartridge 11Y. Thereby, in the state where the toner cartridge 11Y is mounted to the drum cartridge 10Y, the toner receiving hole 214A can receive the toner discharged from the toner discharge hole 312A. The toner discharge hole 312A will be described later.

2.1.2.4 Shutter 215

Figure 6B:
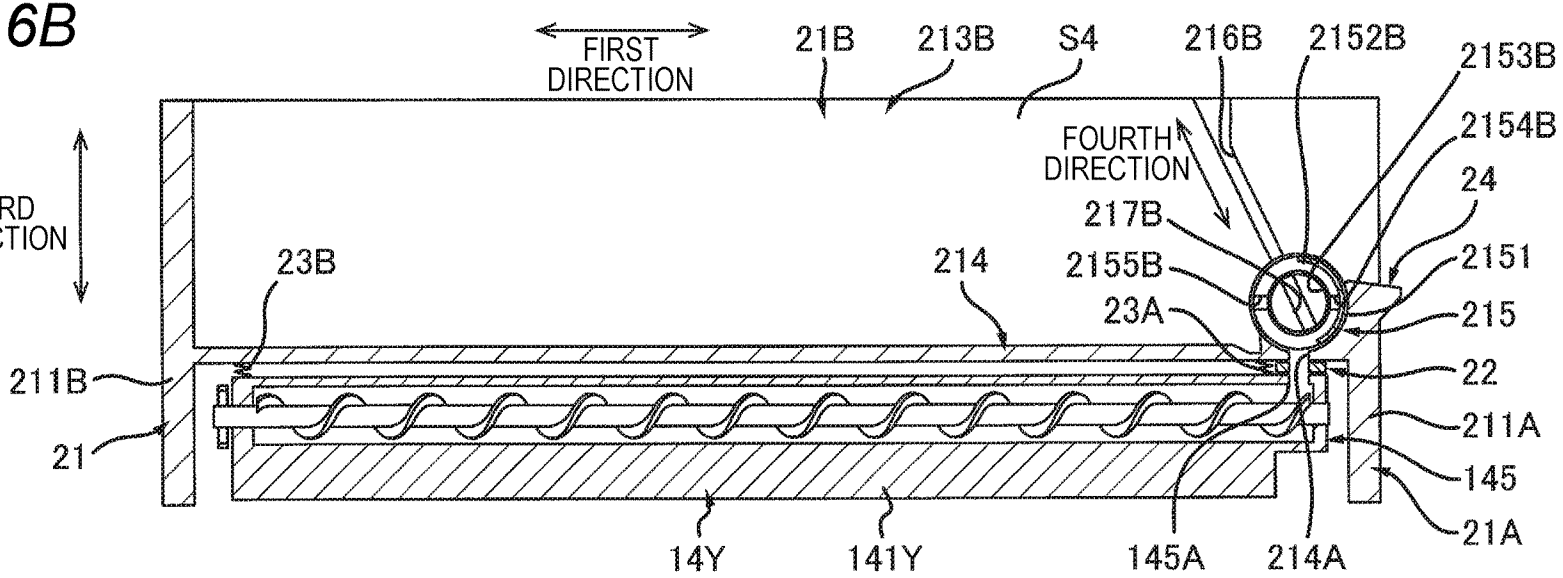
FIG. 6B shows the drum cartridge shown in FIG. 6A, depicting a state where a shutter is located in an opened position.

As shown in FIGS. 6A and 6B, the shutter 215 can rotate between the closed position (refer to FIG. 6A) and the opened position (refer to FIG. 6B). In a state where the shutter 215 is located in the closed position, the shutter 215 closes the toner receiving hole 214A. In a state where the shutter 215 is located in the opened position, the toner receiving hole 214A is opened.

As shown in FIG. 6A, the shutter 215 has a shutter main body 2151, and shutter side plates 2152A (refer to FIG. 4) and 2152B.

The shutter main body 2151 extends in the second direction. The shutter main body 2151 is a circular arc-shaped plate.

As shown in FIG. 4, the shutter side plate 2152A is located on the surface S2 (refer to FIG. 3) of the side plate 213A. The shutter side plate 2152A is connected to one end portion of the shutter main body 2151 in the second direction. The shutter side plate 2152A has a circular shape. The shutter side plate 2152A has a through-hole 2153A. The groove 217A is located in the through-hole 2153A. The shutter side plate 2152A has a groove 2154A, and a groove 2155A.

In the state where the shutter 215 is located in the closed position, the groove 2154A is located on an opposite side to the toner cartridge guide 216A with respect to the groove 217A in the fourth direction. In the state where the shutter 215 is located in the closed position, the groove 2154A extends in the fourth direction. In the state where the shutter 215 is located in the closed position, the groove 2154A communicates with the groove 217A.

In the state where the shutter 215 is located in the closed position, the groove 2155A is located between the toner cartridge guide 216A and the groove 217A in the fourth direction. In the state where the shutter 215 is located in the closed position, the groove 2155A extends in the fourth direction. In the state where the shutter 215 is located in the closed position, the groove 2155A communicates with the toner cartridge guide 216A and the groove 217A.

As shown in FIG. 6A, the shutter side plate 2152B is located on the surface S4 of the side plate 213B. The shutter side plate 2152B is connected to the other end portion of the shutter main body 2151 in the second direction. The shutter side plate 2152B has a circular shape. The shutter side plate 2152B has a through-hole 2153B. The groove 217B is located in the through-hole 2153B. The shutter side plate 2152B has a groove 2154B and a groove 2155B.

In the state where the shutter 215 is located in the closed position, the groove 2154B is located on an opposite side to the toner cartridge guide 216B with respect to the groove 217B in the fourth direction. In the state where the shutter 215 is located in the closed position, the groove 2154B extends in the fourth direction. In the state where the shutter 215 is located in the closed position, the groove 2154B communicates with the groove 217B.

In the state where the shutter 215 is located in the closed position, the groove 2155B is located between the toner cartridge guide 216B and the groove 217B in the fourth direction. In the state where the shutter 215 is located in the closed position, the groove 2155B extends in the fourth direction. In the state where the shutter 215 is located in the closed position, the groove 2155B communicates with the toner cartridge guide 216B and the groove 217B.

2.2 Details of Developing Device 14Y

As shown in FIG. 4, the developing device 14Y includes two projections 143A and 143B, in addition to the developing housing 141Y and the developing roller 142Y.

2.2.1 Details of Developing Housing 141Y

The developing housing 141Y is located between the drum side plate 211A and the drum side plate 211B in the first direction. The developing housing 141Y is supported to the shaft 212 (refer to FIG. 3). The developing housing 141Y can rotate about the shaft 212. The developing housing 141Y extends in the first direction. The developing housing 141Y has developing side plates 144A and 144B, and a protrusion 145.

2.2.1.1 Developing Side Plate 144A

The developing side plate 144A is located at one end portion of the developing housing 141Y in the first direction. The developing side plate 144A extends in the third direction. The developing side plate 144A is configured to support one end portion of the developing roller 142Y in the first direction.

2.2.1.2 Developing Side Plate 144B

The developing side plate 144B is located at the other end portion of the developing housing 141Y in the first direction. The developing side plate 144B is located distant from the developing side plate 144A in the first direction. The developing side plate 144B extends in the third direction. The developing side plate 144B is configured to support the other end portion of the developing roller 142Y in the first direction.

2.2.1.3 Protrusion 145

The protrusion 145 is located on an opposite side to the developing side plate 144B with respect to the developing side plate 144A in the first direction. The protrusion 145 extends from the developing side plate 144A. The protrusion 145 extends in the first direction. That is, the protrusion 145 protrudes from the developing side plate 144A toward an opposite side to the developing side plate 144B in the first direction.

As shown in FIG. 6A, the protrusion 145 has a developing opening 145A. In other words, the developing housing 141Y has a developing opening 145A. The developing opening 145A communicates with the toner receiving hole 214A. Thereby, the toner that enters the toner receiving hole 214A enters the developing housing 141Y through the developing opening 145A.

2.2.2 Projections 143A and 143B

As shown in FIG. 4, the projection 143A is located on an opposite side to the developing side plate 144B with respect to the developing side plate 144A in the first direction. The projection 143A extends in the first direction. Specifically, the projection 143A is one end portion of the developing roller 142Y in the first direction. Note that, the projection 143A may extend from the developing side plate 144A. Also, the projection 143A may be attached to the developing side plate 144A. The projection 143A has a circular column shape. The projection 143A is fitted in the hole H2 (refer to FIG. 5) of the drum side plate 211A. In the state where the projection 143A is fitted in the hole H2, the projection 143A can move relative to the drum side plate 211A in a direction in which the developing housing 141Y (refer to FIG. 3) rotates about the shaft 212.

As shown in FIG. 4, the projection 143B is located on an opposite side to the developing side plate 144A with respect to the developing side plate 144B in the first direction. The projection 143B extends in the first direction. Specifically, the projection 143B is the other end portion of the developing roller 142Y in the first direction. Note that, the projection 143B may extend from the developing side plate 144B. Also, the projection 143B may be attached to the developing side plate 144B. The projection 143B has a circular column shape. The projection 143B is fitted in a hole of the drum side plate 211B. Note that, the hole of the drum side plate 211B is not shown. The hole of the drum side plate 211B has the same shape as the hole H2 of the drum side plate 211A. For this reason, in a state where the projection 143B is fitted in the hole, the projection 143B can move relative to the drum side plate 211B in a direction in which the developing housing 141Y rotates about the shaft 212.

2.3 Seal Member 22

As shown in FIG. 6A, the seal member 22 is located between the protrusion 145 of the developing housing 141Y and the bottom plate 214 of the toner cartridge support part 21B. The seal member 22 is in contact with the protrusion 145 of the developing housing 141Y. The seal member 22 is in contact with the bottom plate 214 of the toner cartridge support part 21B. The seal member 22 surrounds the developing opening 145A and the toner receiving hole 214A. The seal member 22 suppresses the toner, which enters the developing opening 145A through the toner receiving hole 214A, from being leaked between the developing housing 141Y and the bottom plate 214 of the toner cartridge support part 21B.

2.4 Springs 23A and 23B

The spring 23A is located between one end portion of the developing housing 141Y in the first direction and the bottom plate 214 of the toner cartridge support part 21B. The spring 23A presses one end portion of the developing housing 141Y in the first direction toward the photosensitive drum 12Y.

The spring 23B is located distant from the spring 23A in the first direction. The spring 23B is located between the other end portion of the developing housing 141Y in the first direction and the bottom plate 214 of the toner cartridge support part 21B. The spring 23B presses the other end portion of the developing housing 141Y in the first direction toward the photosensitive drum 12Y.

2.5 Stopper 24

Figure 8:
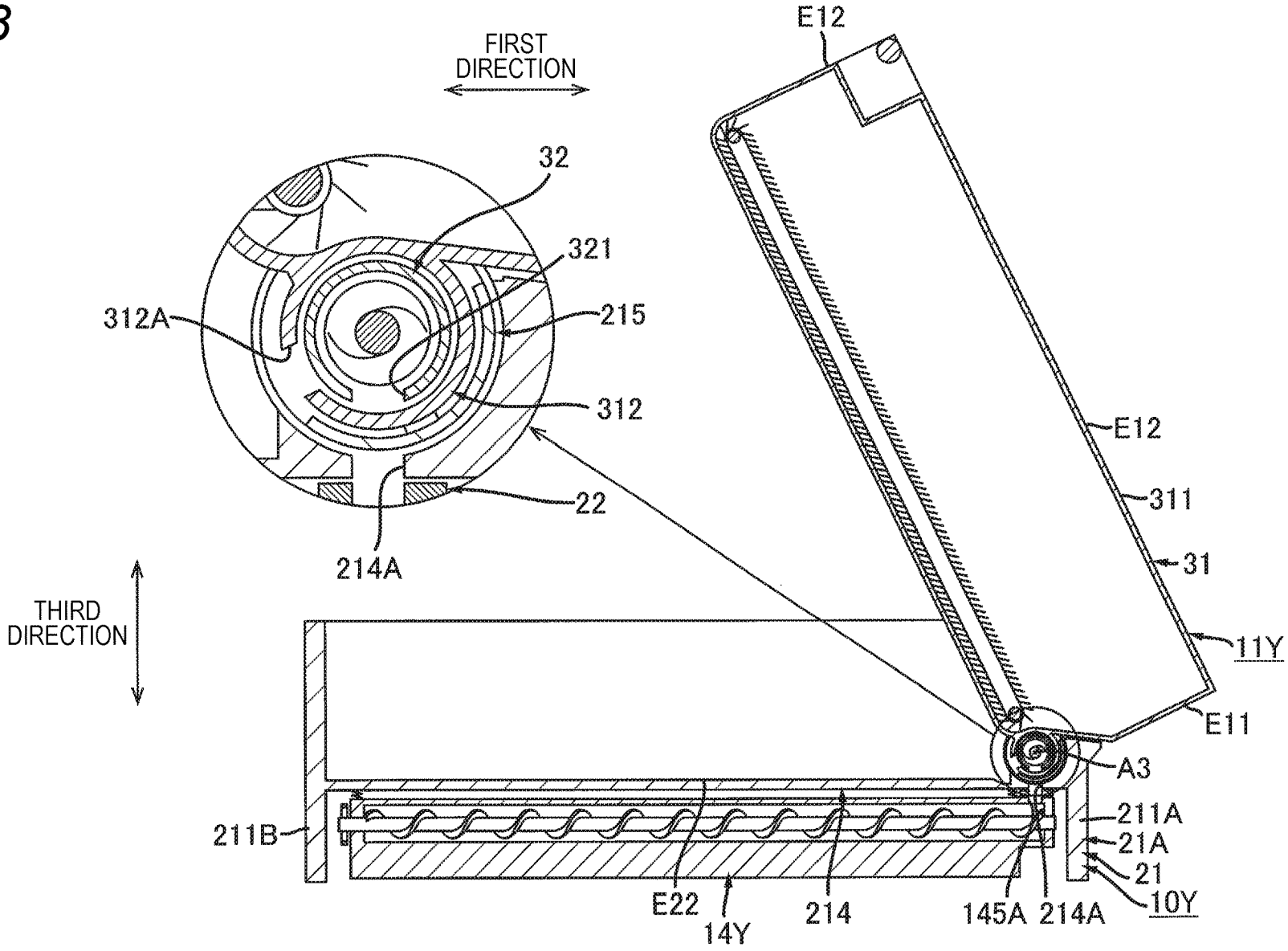
FIG. 8 is a sectional view of the process cartridge shown in FIG. 7, depicting a state where the toner cartridge is mounted to the drum cartridge and the toner housing is located in a first position.

As shown in FIG. 6A, the stopper 24 is located at one end portion of the toner cartridge support part 21B in the first direction. The stopper 24 is located on one side of the drum side plate 211A in the third direction. The stopper 24 fixes a toner housing 31, which moves from a second position (refer to FIG. 7) to a first position (refer to FIG. 8), in the first position. The first position and the second position of the toner housing 31 will be described later. As shown in FIG. 8, in a state where the toner housing 31 is located in the first position, a part of the toner housing 31 protrudes from the drum frame 21 in the first direction.

3. Details of Toner Cartridge 11Y

Subsequently, the toner cartridge 11Y is described in detail with reference to FIGS. 7 to 12. Note that, in descriptions of the toner cartridge 11Y, "the first direction", "the second direction" and "the third direction" are "the first direction", "the second direction" and "the third direction" in a state where "the toner cartridge 11Y is mounted to the drum cartridge 10Y and the toner housing 31 is located in the second position".

Figure 9:
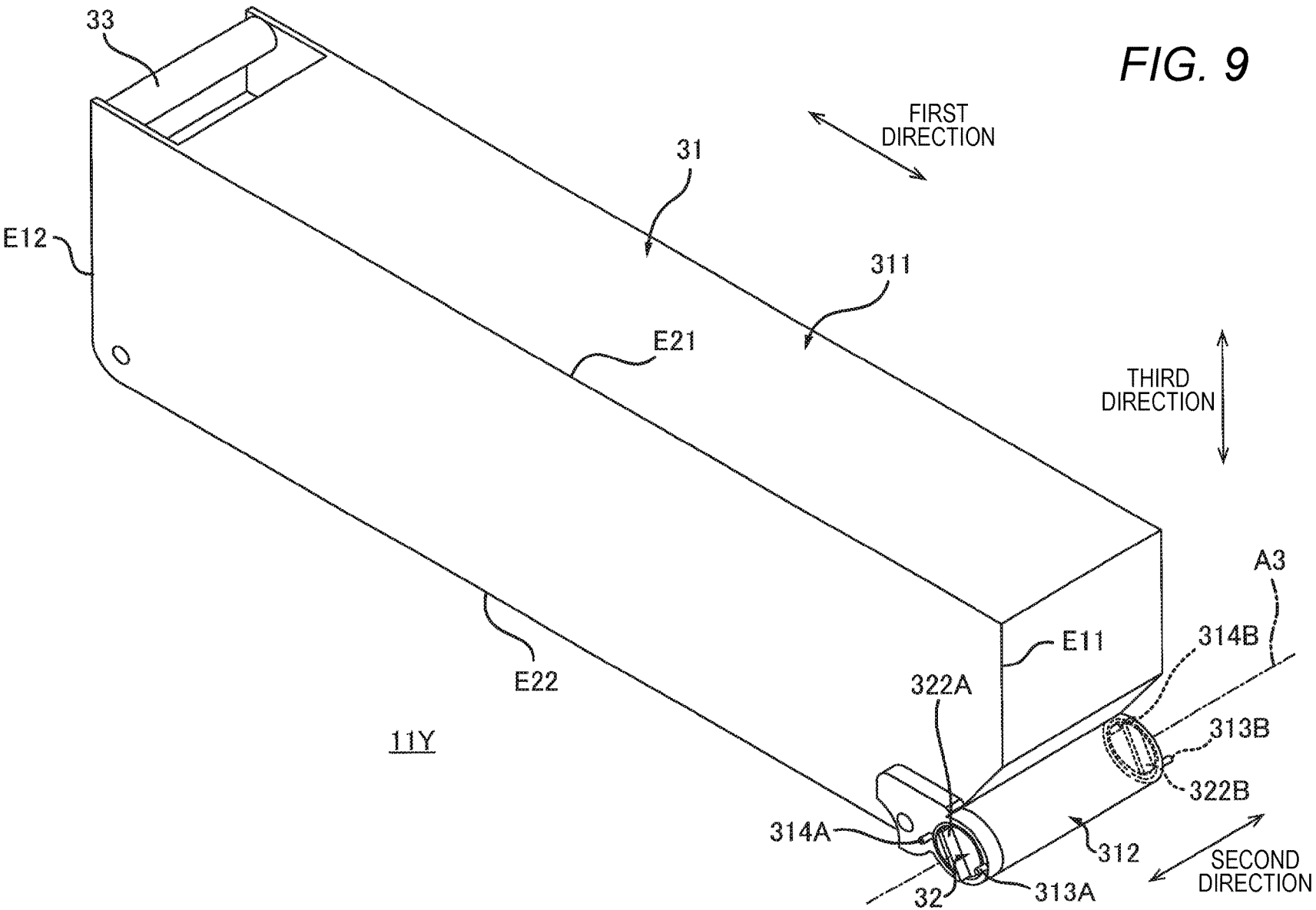
FIG. 9 is a perspective view of the toner cartridge.

As shown in FIG. 9, the toner cartridge 11Y extends in the first direction. The toner cartridge 11Y has a first end portion E11 and a second end portion E12 in the first direction. The second end portion E12 is located distant from the first end portion E11 in the first direction. Also, the toner cartridge 11Y extends in the third direction. The toner housing 31 has one end portion E21 and the other end portion E22 in the third direction. The other end portion E22 is located distant from one end portion E21 in the third direction.

Figure 12:
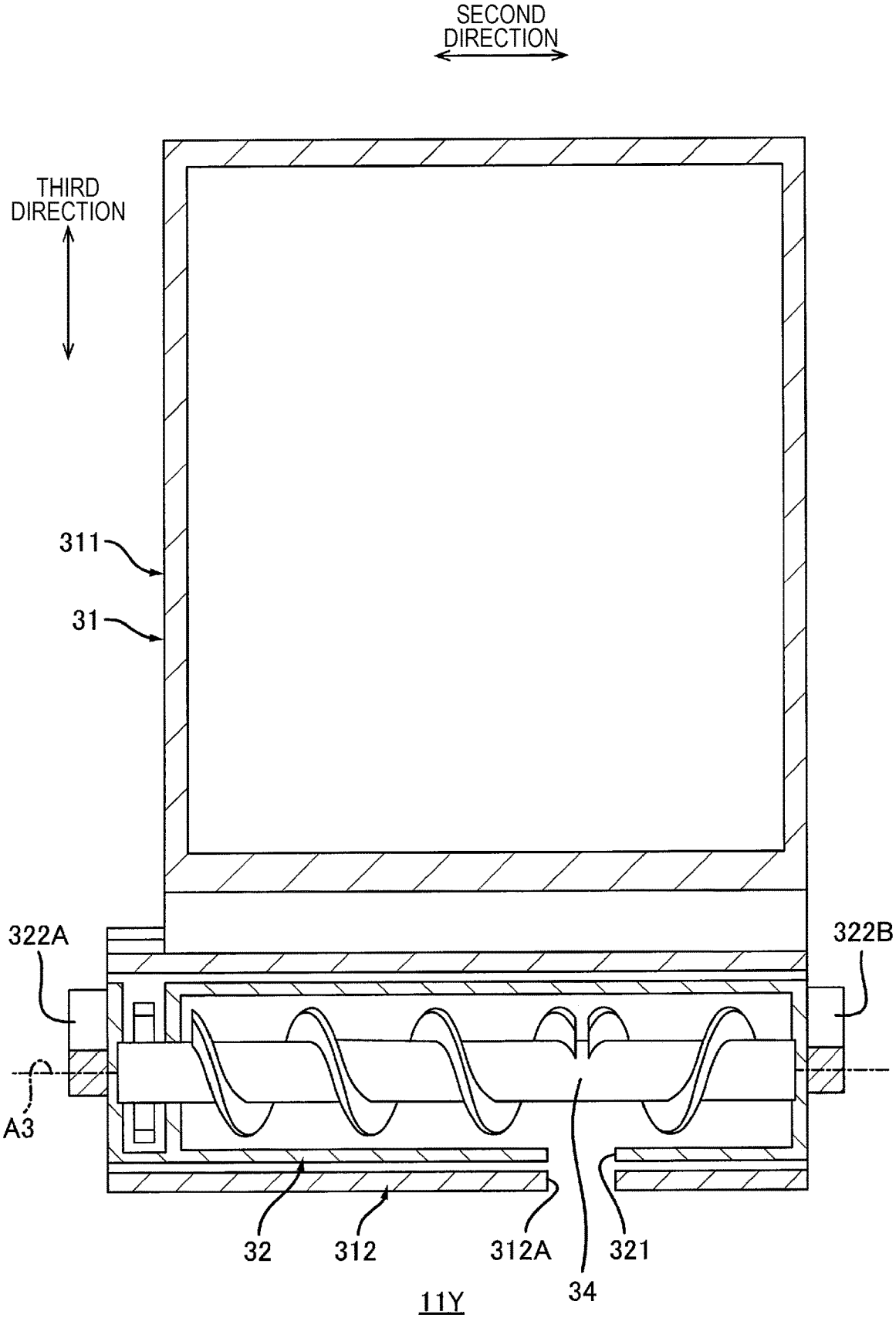
FIG. 12 is a XII-XII sectional view of the toner cartridge shown in FIG. 11B.

The toner cartridge 11Y includes a toner housing 31, a toner shutter 32, a grip 33, and an auger screw 34 (refer to FIG. 12).

3.1 Toner Housing 31

In the toner housing 31, the toner is accommodated. The toner housing 31 extends in the first direction.

As shown in FIGS. 7 and 8, in the state where the toner cartridge 11Y is mounted to the drum cartridge 10Y, the toner housing 31 can rotate about an axis A3 between the first position (refer to FIG. 8) and the second position (refer to FIG. 7). The axis A3 extends in the second direction.

As shown in FIG. 9, the toner housing 31 has a first accommodation part 311, a second accommodation part 312, and four projections 313A, 314A, 313B and 314B.

3.1.1 First Accommodation Part 311

In the first accommodation part 311, the toner is accommodated. The first accommodation part 311 extends in the first direction. The first accommodation part 311 has a square tube shape.

3.1.2 Second Accommodation Part 312

The second accommodation part 312 is located at the first end portion E11 of the toner cartridge 11Y in the first direction. Also, the second accommodation part 312 is located at the other end portion E22 of the toner cartridge 11Y in the third direction. The second accommodation part 312 communicates with the first accommodation part 311 via an opening (not shown). The second accommodation part 312 extends in the second direction. The second accommodation part 312 has a cylindrical shape. A volume of the second accommodation part 312 is smaller than a volume of the first accommodation part 311.

As shown in FIGS. 7 and 8, in the state where the toner cartridge 11Y is mounted to the drum cartridge 10Y, the toner housing 31 can rotate with respect to the second accommodation part 312 between the first position (refer to FIG. 8) and the second position (refer to FIG. 7). The axis A3 is a central axis of the second accommodation part 312.

As shown in FIG. 7, the second accommodation part 312 has a toner discharge hole 312A. In other words, the toner housing 31 has the toner discharge hole 312A. The toner discharge hole 312A is located at the first end portion E11 of the toner cartridge 11Y in the first direction. The toner discharge hole 312A can discharge the toner in the second accommodation part 312.

3.1.3 Projections 313A, 314A, 313B and 314B

As shown in FIG. 9, the projection 313A is located at one end portion of the second accommodation part 312 in the second direction. The projection 313A extends in the second direction. The projection 313A has a circular column shape. The projection 313A extends from the second accommodation part 312. The projection 313A may also be attached to the second accommodation part 312.

The projection 314A is located at one end portion of the second accommodation part 312 in the second direction. The projection 314A is located distant from the projection 313A in a diametrical direction of the second accommodation part 312. The projection 314A is located distant from the projection 313A in the first direction. The projection 314A extends in the second direction. The projection 314A has a circular column shape. The projection 314A extends from the second accommodation part 312. The projection 314A may also be attached to the second accommodation part 312.

The projection 313B is located at the other end portion of the second accommodation part 312 in the second direction. The projection 313B extends in the second direction. The projection 313B has a circular column shape. The projection 313B extends from the second accommodation part 312. The projection 313B may also be attached to the second accommodation part 312.

The projection 314B is located at the other end portion of the second accommodation part 312 in the second direction. The projection 314B is located distant from the projection 313B in the diametrical direction of the second accommodation part 312. The projection 314B is located distant from the projection 313B in the first direction. The projection 314B extends in the second direction. The projection 314B has a circular column shape. The projection 314B extends from the second accommodation part 312. The projection 314B may also be attached to the second accommodation part 312.

In the state where the toner cartridge 11Y is mounted to the drum cartridge 10Y, the projection 313A is fitted in the groove 2154A (refer to FIG. 4) of the shutter 215 of the drum cartridge 10Y, the projection 314A is fitted in the groove 2155A (refer to FIG. 4) of the shutter 215 of the drum cartridge 10Y, the projection 313B is fitted in the groove 2154B (refer to FIG. 6A) of the shutter 215 of the drum cartridge 10Y, and the projection 314B is fitted in the groove 2155B (refer to FIG. 6A) of the shutter 215 of the drum cartridge 10Y.

Thereby, in the state where the toner cartridge 11Y is mounted to the drum cartridge 10Y, the shutter 215 of the drum cartridge 10Y can rotate together with the toner housing 31.

3.2 Toner Shutter 32

As shown in FIG. 9, the toner shutter 32 is located in the second accommodation part 312. The toner shutter 32 extends in the second direction. The toner shutter 32 has a cylindrical shape.

Figure 10A:
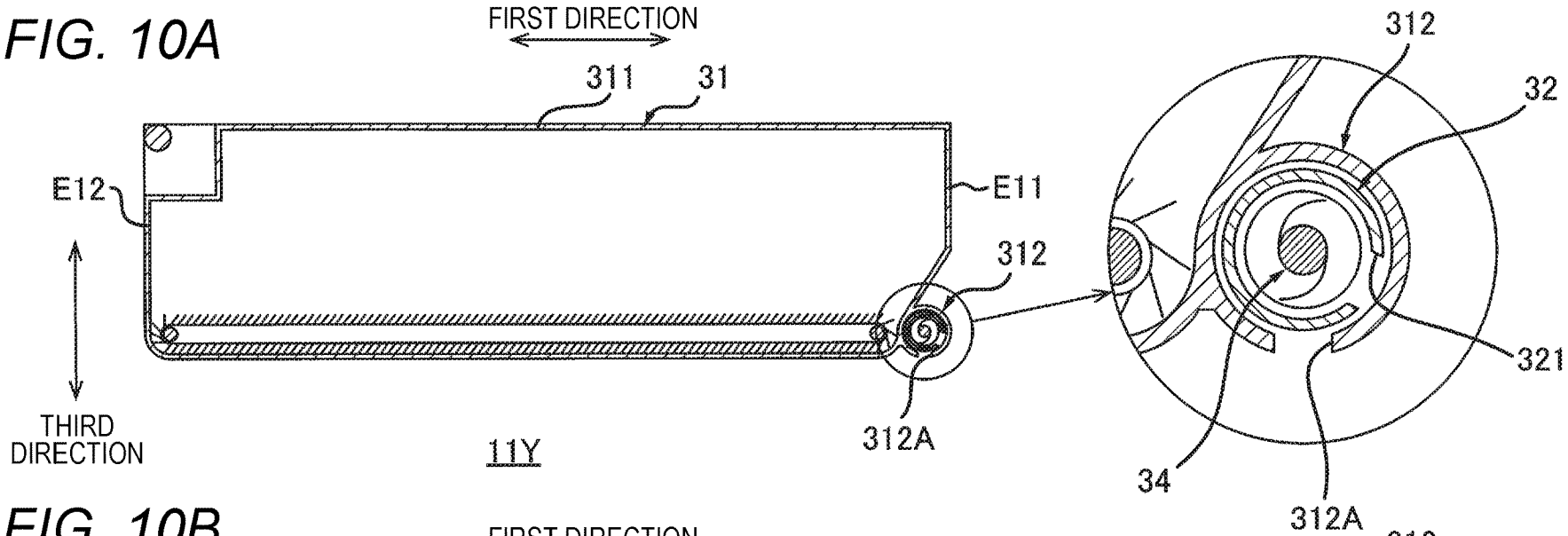
FIG. 10A is a sectional view of the toner cartridge taken along a VI-VI line of FIG. 3, depicting a state where the toner shutter is located in a closed position.
Figure 10B:
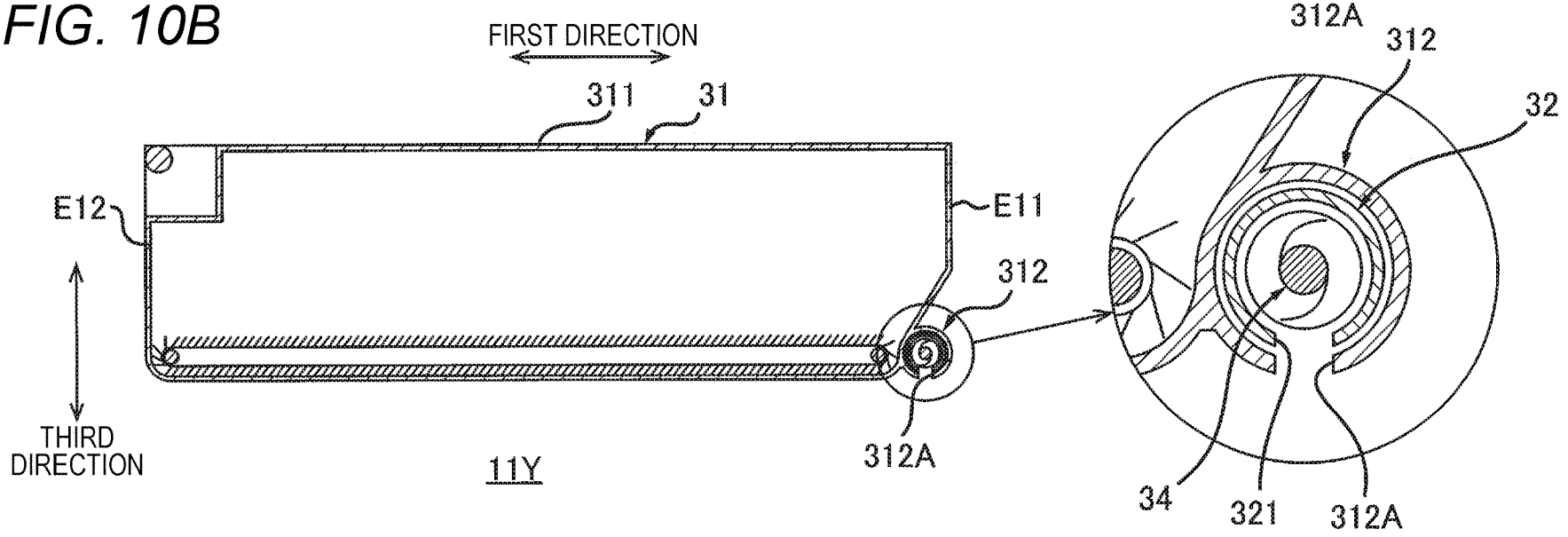
FIG. 10B is a sectional view of the toner cartridge shown in FIG. 10A, depicting a state where the toner shutter is located in an opened position.

As shown in FIGS. 10A and 10B, the toner shutter 32 can move between the closed position (refer to FIG. 10A) and the opened position (refer to FIG. 10B), with respect to the toner discharge hole 312A. In the state where the toner shutter 32 is located in the closed position, the toner shutter 32 closes the toner discharge hole 312A. In the state where the toner shutter 32 is located in the opened position, the toner discharge hole 312A is opened.

Specifically, as shown in FIG. 10A, the toner shutter 32 has an opening 321. In the state where the toner shutter 32 is located in the closed position, the opening 321 is located distant from the toner discharge hole 312A. As shown in FIG. 10B, in the state where the toner shutter 32 is located in the opened position, at least a part of the opening 321 communicates with the toner discharge hole 312A.

As shown in FIG. 9, the toner shutter 32 has projections 322A and 322B.

Figure 11A:
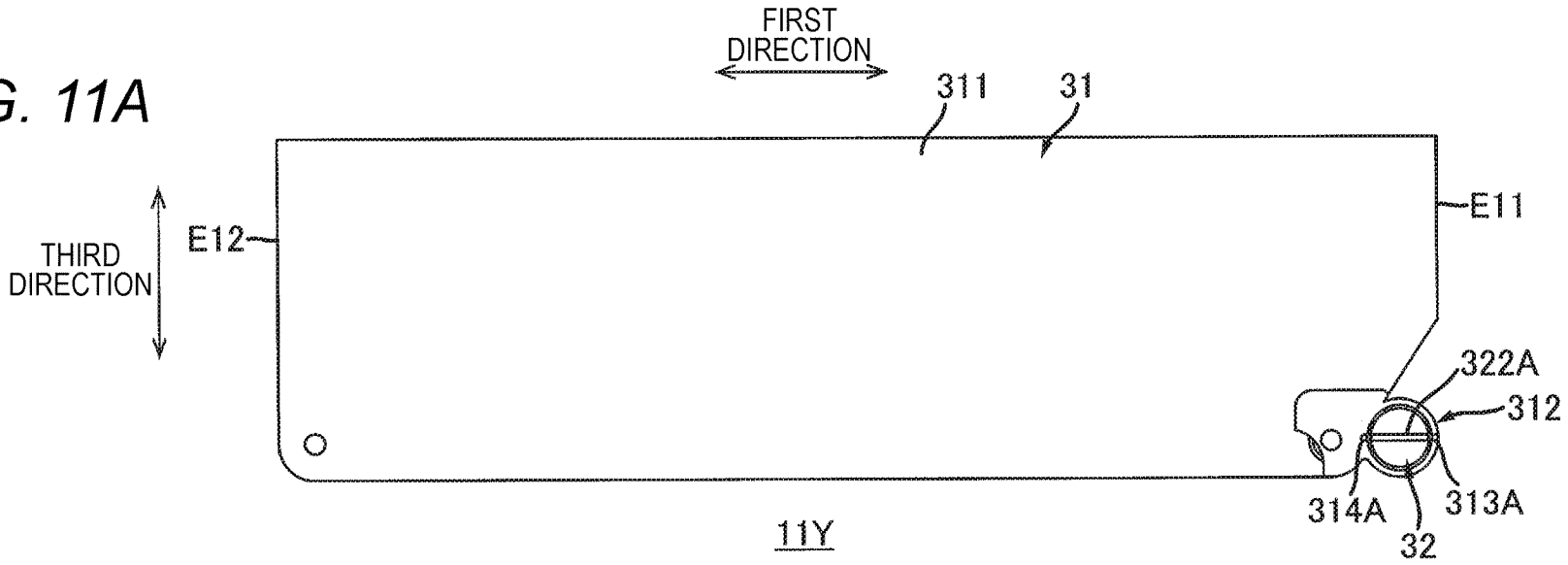
FIG. 11A is a side view of the toner cartridge, as seen from one side in a second direction, depicting a state where the toner shutter is located in the closed position.
Figure 11B:
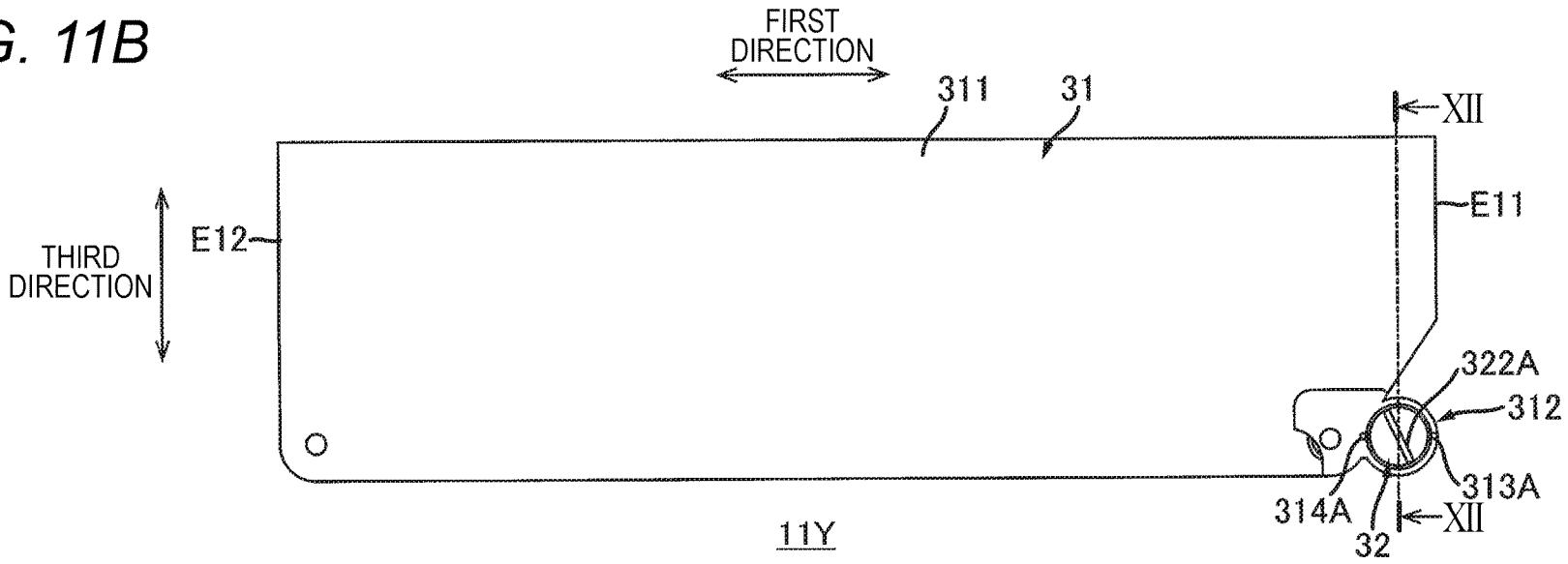
FIG. 11B is a side view of the toner cartridge shown in FIG. 11A, depicting a state where the toner shutter is located in the opened position.

The projection 322A is located at one end portion of the toner shutter 32 in the second direction. The projection 322A extends in a diametrical direction of the toner shutter 32. As shown in FIG. 11A, in the state where the toner shutter 32 is located in the closed position, the projection 322A extends in a direction of connecting the projection 313A and the projection 314A each other. As shown in FIG. 11B, in the state where the toner shutter 32 is located in the opened position, the projection 322A extends in a direction intersecting with the direction of connecting the projection 313A and the projection 314A each other.

As shown in FIG. 9, the projection 322B is located at the other end portion of the toner shutter 32 in the second direction. The projection 322B extends in the same direction as the projection 322A. That is, the projection 322B extends in the diametrical direction of the toner shutter 32. In the state where the toner shutter 32 is located in the closed position, the projection 322B extends in a direction of connecting the projection 313B and the projection 314B each other. In the state where the toner shutter 32 is located in the opened position, the projection 322B extends in a direction intersecting with the direction of connecting the projection 313B and the projection 314B each other.

In the state where the toner cartridge 11Y is mounted to the drum cartridge 10Y, the projection 322A is fitted in the groove 217A (refer to FIG. 4) of the drum cartridge 10Y, and the projection 322B is fitted in the groove 217B (refer to FIG. 6A) of the drum cartridge 10Y.

Thereby, in the state where the toner cartridge 11Y is mounted to the drum cartridge 10Y, the toner shutter 32 is fixed to the drum frame 21.

3.3 Grip 33

The grip 33 is located at the second end portion E12 of the toner cartridge 11Y in the first direction. Also, the grip 33 is located at one end portion E21 of the toner cartridge 11Y in the third direction. When a user rotates the toner housing 31 between the first position and the second position, the grip 33 is held by the user.

3.4 Auger Screw 34

As shown in FIG. 12, the auger screw 34 is located in the second accommodation part 312. The auger screw 34 conveys the toner in the second accommodation part 312 toward the toner discharge hole 312A. The auger screw 34 extends in the second direction along the axis A3.

4. Mounting of Toner Cartridge 11Y to Drum Cartridge 10Y

As shown in FIG. 8, in order to mount the toner cartridge 11Y to the drum cartridge 10Y, in a state where the shutter 215 of the drum cartridge 10Y is located in the closed position with respect to the toner receiving hole 214A and the toner shutter 32 is located in the closed position with respect to the toner discharge hole 312A, the user fits the first end portion E11 of the toner cartridge 11Y to one end portion of the toner cartridge support part 21B in the first direction.

At this time, the projection 313A (refer to FIG. 9) of the toner cartridge 11Y is guided by the toner cartridge guide 216A (refer to FIG. 4), the groove 2155A (refer to FIG. 4) and the groove 217A (refer to FIG. 4) and is fitted in the groove 2154A (refer to FIG. 4). Also, the projection 322A (refer to FIG. 9) is guided by the toner cartridge guide 216A and the groove 2155A and is fitted in the groove 217A. Also, the projection 314A (refer to FIG. 9) is guided by the toner cartridge guide 216A and is fitted in the groove 2155A. Similarly, the projection 313B (refer to FIG. 9) is fitted in the groove 2154B (refer to FIG. 6A), the projection 322B (refer to FIG. 9) is fitted in the groove 217B (refer to FIG. 6A), and the projection 314B (refer to FIG. 9) is fitted in the groove 2155B (refer to FIG. 6A).

As a result, in the state where the toner cartridge 11Y is mounted to the drum cartridge 10Y, the toner housing 31 is located in the first position. That is, in the state where the toner housing 31 is located in the first position, the toner shutter 32 is located in the closed position.

Then, as shown in FIGS. 8 and 7, the user rotates the toner housing 31 from the first position to the second position.

In the state where the toner cartridge 11Y is mounted to the drum cartridge 10Y, when the toner housing 31 is rotated from the first position to the second position, the toner housing 31 is rotated with respect to the toner shutter 32 fixed to the drum frame 21. Thereby, the toner shutter 32 moves from the closed position to the opened position with respect to the toner discharge hole 312A. Also, as the toner housing 31 rotates, the shutter 215 of the drum cartridge 10Y moves from the closed position to the opened position with respect to the toner receiving hole 214A.

Then, as shown in FIG. 7, in the state where the toner cartridge 11Y is mounted to the drum cartridge 10Y, when the toner housing 31 is located in the second position, the shutter 215 of the drum cartridge 10Y is located in the opened position with respect to the toner receiving hole 214A and the toner shutter 32 is located in the opened position with respect to the toner discharge hole 312A. That is, in the state where the toner housing 31 is located in the second position, the toner shutter 32 is located in the opened position.

The toner housing 31 is located in the second position, so that the mounting of the toner cartridge 11Y to the drum cartridge 10Y is completed.

5. Separation of Toner Cartridge 11Y from Drum Cartridge 10Y

In order to separate the toner cartridge 11Y from the drum cartridge 10Y, as shown in FIGS. 7 and 8, the user rotates the toner housing 31 from the second position to the first position.

Then, the toner housing 31 is rotated with respect to the toner shutter 32, so that the toner shutter 32 moves from the opened position to the closed position with respect to the toner discharge hole 312A. Also, as the toner housing 31 rotates, the shutter 215 of the drum cartridge 10Y moves from the opened position to the closed position with respect to the toner receiving hole 214A.

Then, as shown in FIG. 8, in the state where the toner cartridge 11Y is mounted to the drum cartridge 10Y, when the toner housing 31 is located in the first position, the shutter 215 of the drum cartridge 10Y is located in the closed position with respect to the toner receiving hole 214A and the toner shutter 32 is located in the closed position with respect to the toner discharge hole 312A.

Then, the user pulls out the toner cartridge 11Y from the toner cartridge support part 21B. Thereby, the separation of the toner cartridge 11Y from the drum cartridge 10Y is completed.

6. Operational Effects (1) According to the process cartridge 5Y, as shown in FIGS. 7 and 8, the toner housing 31 can rotate about the axis A3 extending in the second direction between the first position (refer to FIG. 8) and the second position (refer to FIG. 7).

For this reason, even when a space in the second direction is small, it is possible to rotate the toner housing 31.

As a result, it is possible to increase a size of the toner cartridge 11Y by using the space in the second direction.

(2) According to the process cartridge 5Y, as shown in FIG. 9, the toner cartridge 11Y has the toner discharge hole 312A at the first end portion E11, and has the grip 33 at the second end portion E12 distant from the first end portion E11.

For this reason, the user can rotate the toner housing 31 about the first end portion E11 as a support point in which the toner discharge hole 312A is located, while holding the grip 33 located at the second end portion E12.

For this reason, even when the toner cartridge 11Y is enlarged the toner cartridge 11Y is heavy, it is possible to easily rotate the toner housing 31.

(3) According to the process cartridge 5Y, as shown in FIG. 6A, the drum cartridge 10Y has the seal member 22. The seal member 22 is located between the protrusion 145 of the developing housing 141Y and the bottom plate 214 of the toner cartridge support part 21B. The seal member 22 surrounds the developing opening 145A and the toner receiving hole 214A.

For this reason, it is possible to suppress the toner, which enters the developing opening 145A through the toner receiving hole 214A, from being leaked between the toner cartridge support part 21B and the developing housing 141Y by the seal member 22.

Also, even when the developing housing 141Y moves with respect to the toner cartridge support part 21B of the drum frame 21, the seal member 22 is deformed to suppress the toner from being leaked.

(4) According to the image forming apparatus 1, even when a space between the process cartridge 5Y and the process cartridge 5M is small, it is possible to easily rotate the toner housing 31 of the process cartridge 5Y, as described above.

For this reason, it is possible to increase a size of the toner cartridge 11Y by using the space between the process cartridge 5Y and the process cartridge 5M.

7. Second Illustrative Embodiment

Subsequently, an image forming apparatus 100 of a second illustrative embodiment is described with reference to FIGS. 13 to 17. In the second illustrative embodiment, the similar members to the first illustrative embodiment are denoted with the same reference signs and the descriptions thereof are omitted.

Also, in the second illustrative embodiment, the process cartridge 5C is described in detail. The process cartridges 5Y, 5M and 5K are described in a similar manner to the process cartridge 5C. For this reason, the descriptions of the process cartridges 5Y, 5M and 5K are omitted.

7.1 Main Body Housing 101

Figure 13:
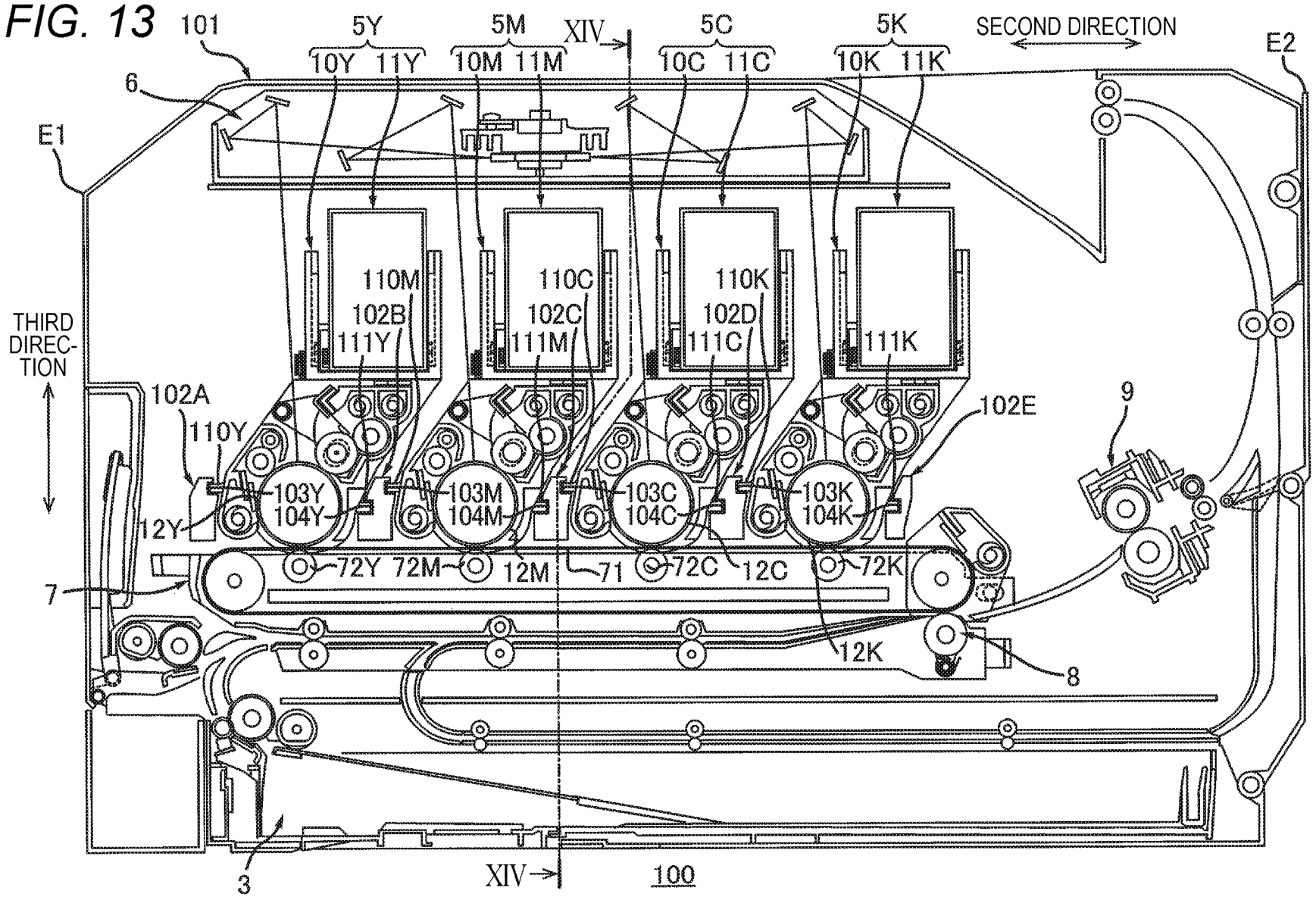
FIG. 13 is a schematic configuration view of an image forming apparatus of a second illustrative embodiment.

As shown in FIG. 13, a main body housing 101 of the image forming apparatus 100 has no opening at the first end portion E1 in the second direction.

Figure 14:
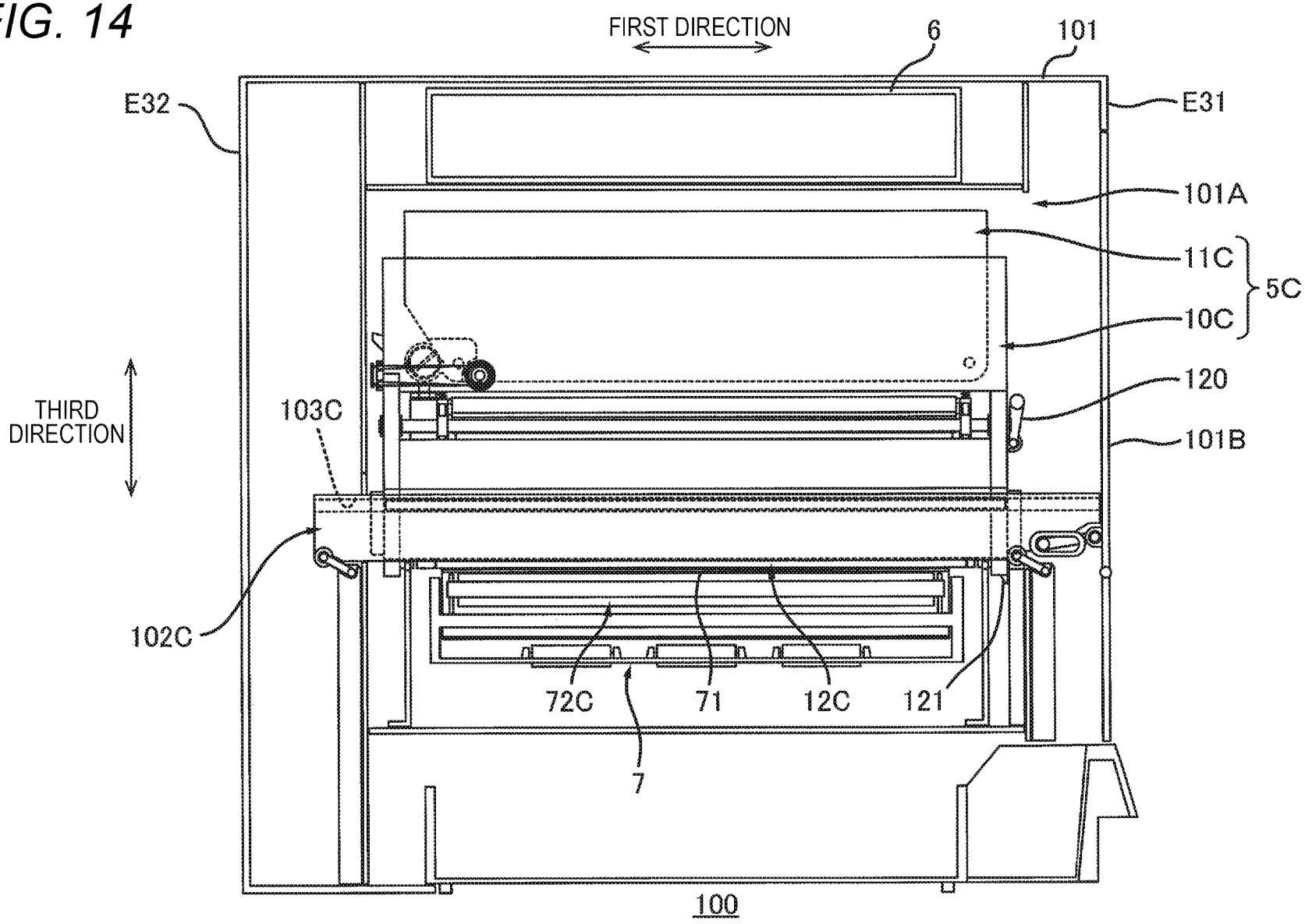
FIG. 14 is a XIV-XIV sectional view of the image forming apparatus shown in FIG. 13.

As shown in FIG. 14, the main body housing 101 has a first end portion E31 and a second end portion E32 in the first direction. The second end portion E32 is located distant from the first end portion E31 in the first direction. The main body housing 101 has an opening 101A, and a cover 101B.

The opening 101A is located at the first end portion E31.

Figure 15:
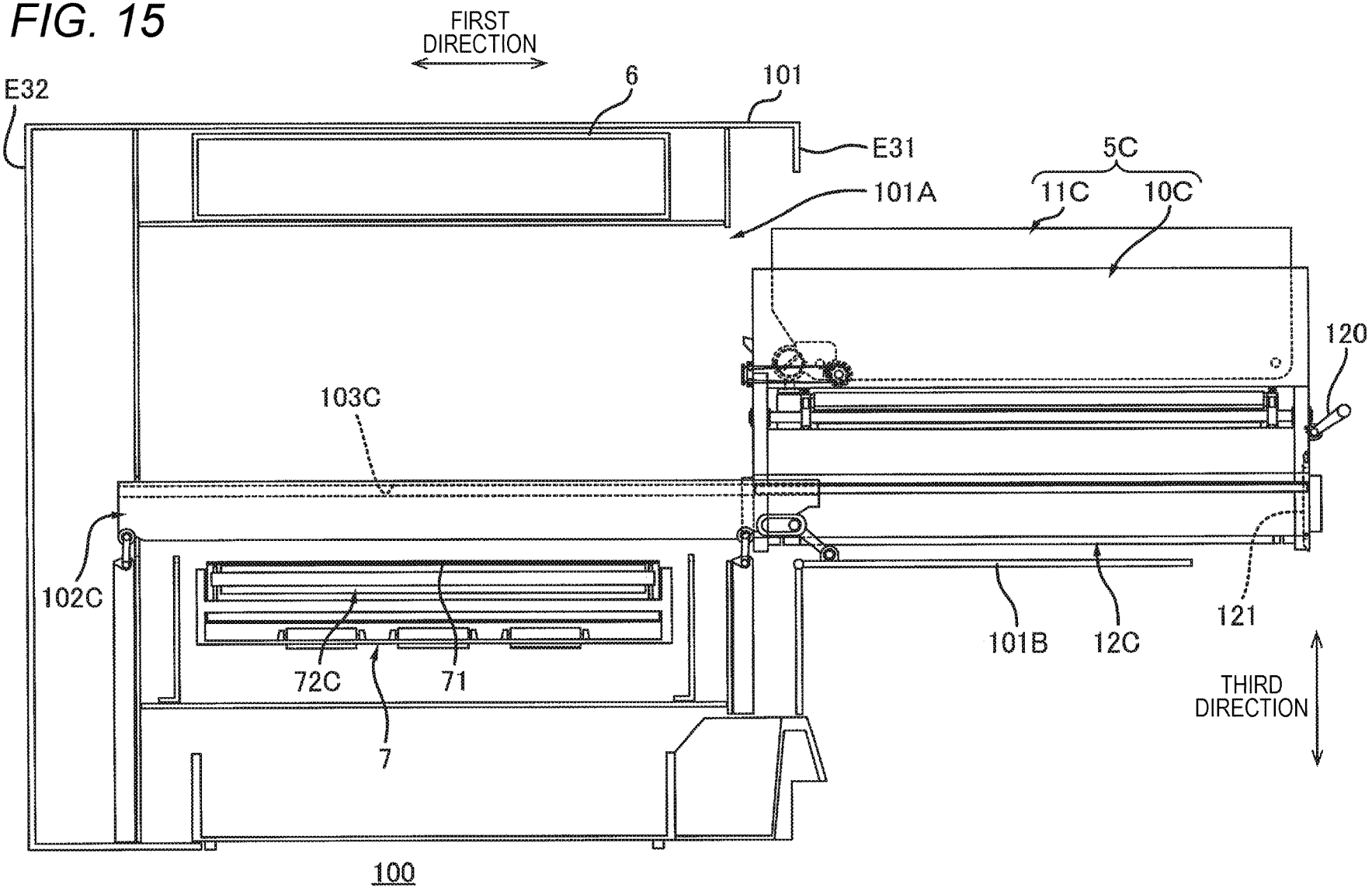
FIG. 15 illustrates movement of the process cartridge shown in FIG. 14, depicting a state where the cover is located in the cover-opened position and the process cartridge is located in the outer position.

The cover 101B can move between a cover-closed position (refer to FIG. 14) and a cover-opened position (refer to FIG. 15). As shown in FIG. 14, in a state where the cover 101B is located in the cover-closed position, the cover 101B closes the opening 101A. As shown in FIG. 15, in a state where the cover 101B is located in the cover-opened position, the opening 101A is opened.

7.2 Process Cartridge Guides 102A to 102E

The image forming apparatus 100 has no drawer 4. In the second illustrative embodiment, as shown in FIG. 15, the process cartridge 5C can move in the first direction between an inner position (refer to FIG. 14) and an outer position (refer to FIG. 15) through the opening 101A. As shown in FIG. 14, in a state where the process cartridge 5C is located in the inner position, the process cartridge 5C is located inside of the main body housing 101. As shown in FIG. 15, in a state where the process cartridge 5C is located in the outer position, the process cartridge 5C is located outside of the main body housing 101.

Specifically, the image forming apparatus 100 has a plurality of process cartridge guides 102A, 102B, 102C, 102D and 102E.

The process cartridge guide 102A is located on an opposite side to the process cartridge 5M with respect to the process cartridge 5Y in the second direction. The process cartridge guide 102A is configured to guide one end portion of the process cartridge 5Y in the second direction. Specifically, the process cartridge guide 102A has a guide groove 103Y.

The guide groove 103Y extends in the first direction. In the guide groove 103Y, a projection 110Y of the process cartridge 5Y is fitted. The projection 110Y is located at one end portion of the process cartridge 5Y in the second direction.

The process cartridge guide 102B is located between the process cartridge 5Y and the process cartridge 5M in the second direction. The process cartridge guide 102B is configured to guide the other end portion of the process cartridge 5Y in the second direction and to guide one end portion of the process cartridge 5M in the second direction. Specifically, the process cartridge guide 102B has a guide groove 104Y, and a guide groove 103M.

The guide groove 104Y extends in the first direction. In the guide groove 104Y, a projection 111Y of the process cartridge 5Y is fitted. The projection 111Y is located at the other end portion of the process cartridge 5Y in the second direction. The process cartridge 5Y can move in the first direction along the guide grooves 103Y and 104Y in a state where the projection 110Y is fitted in the guide groove 103Y and the projection 111Y is fitted in the guide groove 104Y. That is, when the process cartridge 5Y moves between the inner position and the outer position, the process cartridge guide 102B guides the process cartridge 5Y, together with the process cartridge guide 102A.

The guide groove 103M is described in a similar manner to the guide groove 103Y. For this reason, the descriptions of the guide groove 103M are omitted.

The process cartridge guide 102C is located between the process cartridge 5M and the process cartridge 5C in the second direction. The process cartridge guide 102C is described in a similar manner to the process cartridge guide 102B. For this reason, the descriptions of the process cartridge guide 102B are omitted.

The process cartridge guide 102D is located between the process cartridge 5C and the process cartridge 5K in the second direction. The process cartridge guide 102C is described in a similar manner to the process cartridge guide 102B. For this reason, the descriptions of the process cartridge guide 102B are omitted.

The process cartridge guide 102E is located on an opposite side to the process cartridge 5C with respect to the process cartridge 5K in the second direction. The process cartridge guide 102E is configured to guide the other end portion of the process cartridge 5K in the second direction. Specifically, the process cartridge guide 102E has a guide groove 104K. The guide groove 104K is described in a similar manner to the guide groove 104Y. For this reason, the descriptions of the guide groove 104K are omitted.

Figure 16:
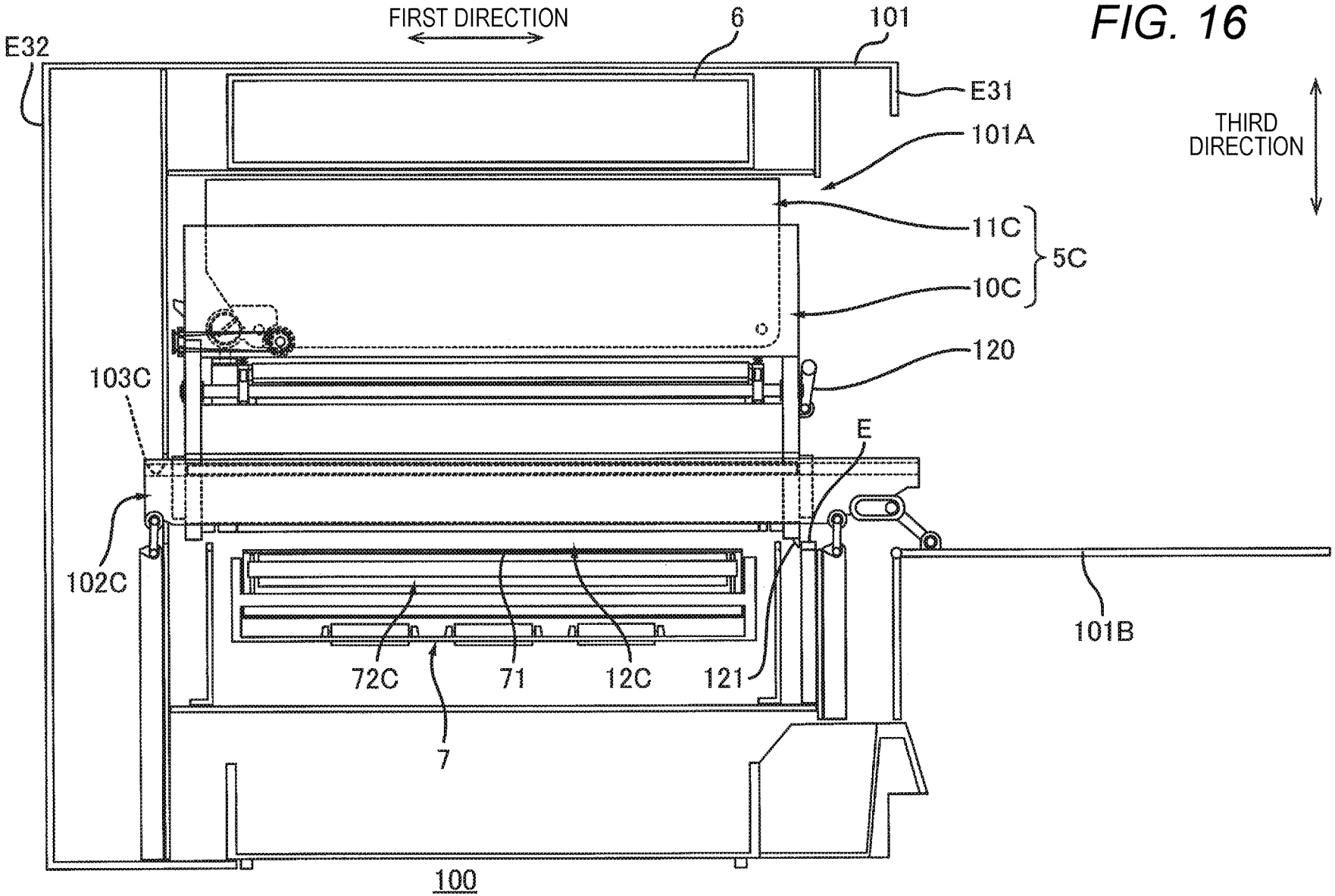
FIG. 16 illustrates movement of a stopper shown in FIG. 14, depicting a state where a handle is located in a first handle position and the stopper is located in a protrusion position.

As shown in FIGS. 14 and 16, the process cartridge guide 102C can move in the third direction, in conjunction with the movement of the cover 101B. When the cover 101B moves from the cover-closed position (refer to FIG. 14) to the cover-opened position (refer to FIG. 16, the process cartridge guide 102C moves away from the belt 71 in the third direction, in conjunction with the movement of the cover 101B. That is, in the state where the process cartridge 5C is located in the inner position, when the cover 101B moves from the cover-closed position to the cover-opened position, the process cartridge guide 102C moves in a direction in which the photosensitive drum 12C separates from the belt 71, in conjunction with the movement of the cover 101B. Thereby, in the state where the process cartridge 5C is located in the inner position, when the cover 101B moves from the cover-closed position to the cover-opened position, the photosensitive drum 12C separates from the belt 71.

Also, when the cover 101B moves from the cover-opened position (refer to FIG. 16) to the cover-closed position (refer to FIG. 14), the process cartridge guide 102C moves toward the belt 71 in the third direction, in conjunction with the movement of the cover 101B. Thereby, in the state where the process cartridge 5C is located in the inner position and the cover 101B is located in the cover-closed position, the belt 71 is in contact with the photosensitive drum 12C.

7.3 Handle 120 and Stopper 121

The process cartridge 5C of the second illustrative embodiment has a handle 120 and a stopper 121.

The handle 120 is held by the user when the user moves the process cartridge 5C from the inner position to the outer position. The handle 120 can rotate between a first handle position (refer to FIG. 16) and a second handle position (refer to FIG. 17).

The stopper 121 can move between a protrusion position and a retreat position, in conjunction with the rotation of the handle 120.

As shown in FIG. 16, the stopper 121 is located in the protrusion position in a state where the handle 120 is located in the first handle position. In a state where the stopper 121 is located in the protrusion position, the stopper 121 protrudes from the other end portion of the drum side plate 211A in the third direction. In a state where the cover 101B is located in the opened position and the stopper 121 is located in the protrusion position, the stopper 121 is brought into contact with an edge E of the opening 101A in the first direction. Thereby, in the state where the handle 120 is located in the first handle position and the stopper 121 is located in the protrusion position, the stopper 121 stops the movement of the process cartridge 5C from the inner position toward the outer position.

Figure 17:
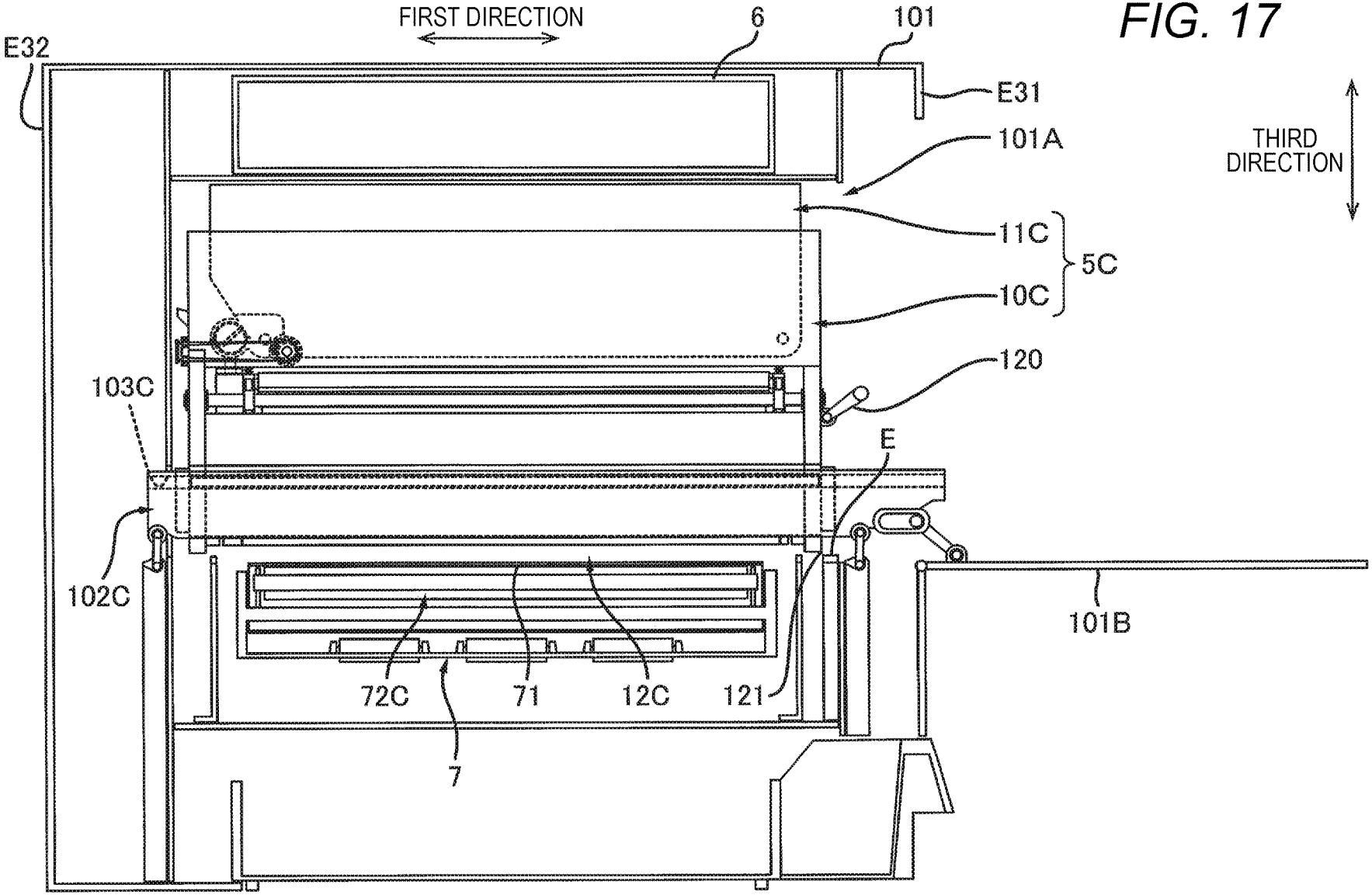
FIG. 17 illustrates movement of the stopper together with FIG. 16, depicting a state where the handle is located in a second handle position and the stopper is located in a retreat position.

On the other hand, as shown in FIG. 17, in a state where the handle 120 is located in the second handle position, the stopper 121 is located in the retreat position. In a state where the stopper 121 is located in the retreat position, the stopper 121 retreats into the drum side plate 211A in the third direction. In a state where the cover 101B is located in the opened position and the stopper 121 is located in the retreat position, the stopper 121 separates from the edge E of the opening 101A in the first direction. Thereby, in the state where the handle 120 is located in the second handle position and the stopper 121 is located in the retreat position, the process cartridge 5C can move from the inner position toward the outer position.

7.4 Separation of Toner Cartridge 11C from Image Forming Apparatus 100

In the second illustrative embodiment, in order to separate the toner cartridge 11C from the image forming apparatus 100, as shown in FIGS. 14 and 16, the user first moves the cover 101B from the cover-closed position to the cover-opened position.

Then, the cover 101B moves from the cover-closed position to the cover-opened position, and the process cartridge 5C moves away from the belt 71 in the third direction. Thereby, as shown in FIG. 16, the photosensitive drum 12C separates from the belt 71.

Then, as shown in FIGS. 16 and 17, the user rotates the handle 120 from the first handle position to the second handle position.

As the handle 120 rotates, the stopper 121 moves from the protrusion position to the retreat position.

Then, as shown in FIGS. 17 and 15, the user pulls out the process cartridge 5C from the inner position to the outer position.

Figure 18:
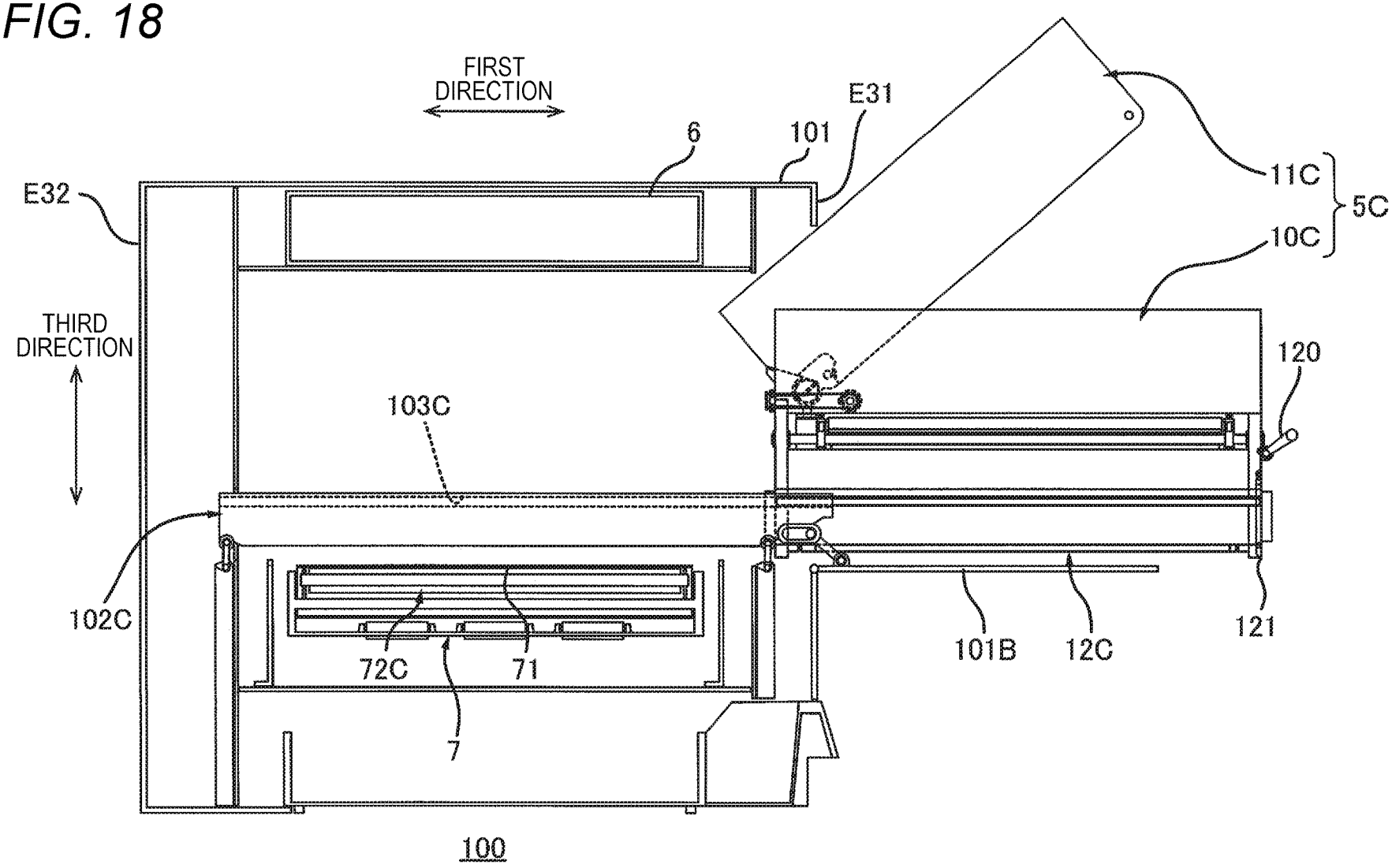
FIG. 18 illustrates separation of the toner cartridge from the drum cartridge in the second illustrative embodiment, depicting a state where the process cartridge is located in the outer position and the toner housing is located in the first position.

Then, as shown in FIGS. 15 and 18, in the state where the process cartridge 5C is located in the outer position, the user moves the toner cartridge 11C from the second position (refer to FIG. 15) to the first position (refer to FIG. 18), thereby removing the toner cartridge 11C from the drum cartridge 10C.

7.5 Operational Effects of Second Illustrative Embodiment

Also in the second illustrative embodiment, the similar effects to the first illustrative embodiment are achieved.

7.6 Modification to Second Illustrative Embodiment

The opening 101A may also be located at the second end portion E32. The process cartridge 5C may move in the first direction between the inner position and the outer position through the opening 101A located at the second end portion E32 in the first direction.

8. Modified Illustrative Embodiments (1) The belt unit 7 may also be a transfer unit configured to transfer the toner to the sheet S. The belt 71 may also be a conveyor belt for conveying the sheet.

(2) The image forming apparatus 1 may also be a dedicated image forming apparatus for single color printing.

As discussed above, the disclosure may provide at least the following illustrative, non-limiting aspects.

(1) A process cartridge of the present disclosure includes a toner cartridge, and a drum cartridge.

The toner cartridge includes a toner housing, and a toner shutter. The toner housing is configured to accommodate toner. The toner housing has a toner discharge hole. The toner discharge hole can discharge the toner. The toner shutter is movable between a closed position and an opened position with respect to the toner discharge hole. In a state the toner shutter is located in the closed position, the toner shutter closes the toner discharge hole. In a state the toner shutter is located in the opened position, the toner discharge hole is opened. The toner cartridge can be mounted to the drum cartridge.

The drum cartridge includes a photosensitive drum, and a drum frame. The photosensitive drum can rotate about a drum axis. The drum axis extends in a first direction. The drum frame is configured to support the photosensitive drum.

In a state the toner cartridge is mounted to the drum cartridge, the toner housing can rotate about an axis between the first position and the second position. The axis extends in a second direction. The second direction intersects with the first direction. In a state the toner housing is located in the first position, the toner shutter is located in the closed position. In a state the toner housing is located in the second position, the toner shutter is located in the opened position.

According to the above configuration, the toner housing can rotate about the axis extending in the second direction between the first position and the second position.

For this reason, even when a space in the second direction is small, it is possible to rotate the toner housing.

As a result, it is possible to increase a size of the toner cartridge by using the space in the second direction.

(2) In the state the toner cartridge is mounted to the drum cartridge, the toner cartridge has a first end portion and a second end portion in the first direction. The toner discharge hole is located at the first end portion. The second end portion is located distant from the first end portion. The toner cartridge may further include a grip. The grip is located at the second end portion.

According to the above configuration, a user can rotate the toner housing about the first end portion as a support point at which the toner discharge hole is located while holding the grip located at the second end portion.

For this reason, even when the toner cartridge is enlarged the toner cartridge is heavy, it is possible to easily rotate the toner housing.

(3) The drum frame includes a drum support part and a toner cartridge support part. The drum support part is configured to support the photosensitive drum. The toner cartridge support part is configured to support the toner cartridge in the state the toner cartridge is mounted to the drum cartridge. The toner cartridge support part may include a first side plate and a second side plate. The first side plate faces the toner cartridge in the second direction in the state the toner cartridge is mounted to the drum cartridge. In the state the toner cartridge is mounted to the drum cartridge, the second side plate is located on an opposite side to the first side plate with respect to the toner cartridge. In the state the toner cartridge is mounted to the drum cartridge, the second side plate faces the toner cartridge in the second direction.

(4) The first side plate may include a first toner cartridge guide. The first toner cartridge guide guides one end portion of the toner cartridge in the second direction at the time when the toner cartridge is mounted to the drum cartridge. The second side plate may include a second toner cartridge guide. The second toner cartridge guide guides the other end portion of the toner cartridge in the second direction at the time when the toner cartridge is mounted to the drum cartridge.

(5) The drum cartridge may have a toner receiving hole. The toner receiving hole can receive the toner discharged from the toner discharge hole in the state the toner cartridge is mounted to the drum cartridge.

(6) The drum cartridge may further include a developing device. The developing device include a developing roller and a developing housing. The developing roller is rotatable about a developing axis. The developing axis extends in the first direction. The developing housing is configured to support the developing roller. The developing housing has a developing opening. In the state the toner cartridge is mounted to the drum cartridge, the toner receiving hole communicates with the developing opening of the developing housing. The toner receiving hole communicates with the toner discharge hole. The developing housing includes a first developing side plate, a second developing side plate, and a protrusion. The first developing side plate is configured to support one end portion of the developing roller in the first direction. The second developing side plate is configured to support the other end portion of the developing roller in the first direction. The protrusion protrudes from the first developing side plate to an opposite side to the second developing side plate in the first direction. The protrusion has the developing opening.

(7) The drum cartridge may further include a seal member. The seal member surrounds the developing opening and the toner receiving hole.

According to the above configuration, it is possible to suppress the toner, which enters the developing opening through the toner receiving hole, from being leaked by the seal member.

(8) In a state the toner housing is located in the first position, a part of the toner housing may protrude from the drum frame in the first direction.

(9) The drum frame may have a stopper. The stopper is configured to stop the toner housing, which moves from the second position to the first position, in the first position.

(10) An image forming apparatus according to the present disclosure includes a main body housing and a first process cartridge. The main body housing has an opening. The first process cartridge is the process cartridge of the present disclosure as explained above. The first process cartridge is mountable to the main body housing.

(11) The image forming apparatus may further include a second process cartridge. The second process cartridge is arranged in alignment with the first process cartridge in the second direction. The second process cartridge is mountable to the main body housing.

According to the above configuration, even when a space between the first process cartridge and the second process cartridge is small, it is possible to easily rotate the toner housing of the first process cartridge.

For this reason, it is possible to increase the size of the toner cartridge by using the space between the first process cartridge and the second process cartridge.

(12) The image forming apparatus may further include a drawer. The drawer is movable between an inner position and an outer position through the opening. In a state the drawer is located in the inner position, the drawer is located inside of the main body housing. In a state the drawer is located in the outer position, the drawer is located outside of the main body housing. The drawer is configured to support the first process cartridge.

(13) The main body housing has a first end portion and a second end portion in the second direction. The second end portion is located distant from the first end portion. The opening may be located at the first end portion. The drawer is movable in the second direction between the inner position and the outer position.

(14) The main body housing has a first end portion and a second end portion in the first direction. The second end portion is located distant from the first end portion. The opening may be located at the first end portion. The first process cartridge is movable in the first direction between an inner position and an outer position through the opening. In a state the first process cartridge is located in the inner position, the first process cartridge is located inside of the main body housing. In a state the first process cartridge is located in the outer position, the first process cartridge is located outside of the main body housing.

(15) The image forming apparatus may further include a process cartridge guide. The process cartridge guide guides the first process cartridge when the first process cartridge moves between the inner position and the outer position. The process cartridge guide is located between the first process cartridge and the second process cartridge in the second direction.

(16) The main body housing further includes a cover. The cover is movable between a cover-closed position and a cover-opened position. In a state the cover is located in the cover-closed position, the cover closes the opening. In a state the cover is located in the cover-opened position, the opening is opened. The image forming apparatus further includes a belt. In a state the first process cartridge is located in the inner position and the cover is located in the cover-closed position, the belt is in contact with the photosensitive drum. When the cover moves from the cover-closed position to the cover-opened position in the state the first process cartridge is located in the inner position, the process cartridge guide may move in a direction in which the photosensitive drum separates from the belt, in conjunction with the movement of the cover.

What is claimed is:

1. A process cartridge comprising:

a toner cartridge comprising:

a toner housing configured to accommodate toner, the toner housing having a toner discharge hole for discharging the toner; and a toner shutter movable between a closed position and an opened position with respect to the toner discharge hole, the toner discharge hole being closed in a case the toner shutter is located in the closed position, the toner discharge hole being opened in a case the toner shutter is located in the opened position; and a drum cartridge comprising:

a photosensitive drum rotatable about a drum axis extending in a first direction; and a drum frame configured to support the photosensitive drum, the toner cartridge being mountable to the drum cartridge, wherein in a state the toner cartridge is mounted to the drum cartridge, the toner housing is rotatable about an axis between a first position and a second position, the axis extending in a second direction intersecting with the first direction, the toner shutter being located in the closed position in a case the toner housing is located in the first position, the toner shutter being located in the opened position in a case the toner housing is located in the second position.

2. The process cartridge according to claim 1, wherein in the state the toner cartridge is mounted to the drum cartridge, the toner cartridge includes a first end portion and a second end portion in the first direction, the toner discharge hole being located at the first end portion, the second end portion being located distant from the first end portion, and wherein the toner cartridge further comprises a grip located at the second end portion.

3. The process cartridge according to claim 1, wherein the drum frame comprises:

a drum support part configured to support the photosensitive drum; and a toner cartridge support part configured to support the toner cartridge in the state the toner cartridge is mounted to the drum cartridge, and wherein the toner cartridge support part comprises:

a first side plate facing the toner cartridge in the second direction in the state the toner cartridge is mounted to the drum cartridge; and a second side plate located on an opposite side to the first side plate with respect to the toner cartridge, the second side plate facing the toner cartridge in the second direction in the state the toner cartridge is mounted to the drum cartridge.

4. The process cartridge according to claim 3, wherein the first side plate comprises a first toner cartridge guide, the first toner cartridge guide being configured to guide one end portion of the toner cartridge in the second direction in a case the toner cartridge is mounted to the drum cartridge, and wherein the second side plate comprises a second toner cartridge guide, the second toner cartridge guide being configured to guide the other end portion of the toner cartridge in the second direction in a case the toner cartridge is mounted to the drum cartridge.

5. The process cartridge according to claim 1, wherein the drum cartridge has a toner receiving hole configured to receive the toner discharged from the toner discharge hole in the state the toner cartridge is mounted to the drum cartridge.

6. The process cartridge according to claim 5, wherein the drum cartridge further comprises a developing device, the developing device comprising:

a developing roller rotatable about a developing axis, the developing axis extending in the first direction; and a developing housing configured to support the developing roller and having a developing opening, wherein the toner receiving hole communicates with the developing opening of the developing housing and the toner discharge hole in the state the toner cartridge is mounted to the drum cartridge, and wherein the developing housing comprises:

a first developing side plate configured to support one end portion of the developing roller in the first direction;

a second developing side plate configured to support the other end portion of the developing roller in the first direction; and a protrusion protruding from the first developing side plate to an opposite side to the second developing side plate in the first direction and having the developing opening.

7. The process cartridge according to claim 6, wherein the drum cartridge further comprises a seal member surrounding the developing opening and the toner receiving hole.

8. The process cartridge according to claim 7, wherein in a state the toner housing is located in the first position, a part of the toner housing protrudes from the drum frame in the first direction.

9. The process cartridge according to claim 1, wherein the drum frame comprises a stopper configured to stop the toner housing, which moves from the second position to the first position, in the first position.

10. An image forming apparatus comprising:

a main body housing having an opening; and a first process cartridge that is the process cartridge according to claim 1 and is mountable to the main body housing.

11. The image forming apparatus according to claim 10, further comprising:

a second process cartridge arranged in alignment with the first process cartridge in the second direction and mountable to the main body housing.

12. The image forming apparatus according to claim 10, further comprising:

a drawer movable between an inner position and an outer position through the opening, the inner position being located inside of the main body housing, the outer position being located outside of the main body housing, the drawer being configured to support the first process cartridge.

13. The image forming apparatus according to claim 12, wherein the main body housing has a first end portion and a second end portion in the second direction, the opening is located at the first end portion, the second end portion being located distant from the first end portion, and wherein the drawer is movable in the second direction between the inner position and the outer position.

14. The image forming apparatus according to claim 10, wherein the main body housing has a first end portion and a second end portion in the first direction, the opening being located at the first end portion, the second end portion being located distant from the first end portion, and wherein the first process cartridge is movable between an inner position and an outer position in the first direction through the opening, the inner position being located inside of the main body housing, the outer position being located outside of the main body housing.

15. The image forming apparatus according to claim 14, further comprising:

a second process cartridge arranged in alignment with the first process cartridge in the second direction, the second process cartridge being mountable to the main body housing; and a process cartridge guide configured to guide the first process cartridge in a case the first process cartridge moves between the inner position and the outer position, the process cartridge guide being located between the first process cartridge and the second process cartridge in the second direction.

16. The image forming apparatus according to claim 15, wherein the main body housing further comprises:

a cover movable between a cover-closed position and a cover-opened position, the cover being configured to:

close the opening in a case the cover is located in the cover-closed position; and open the opening in a case the cover is located in the cover-opened position, wherein the image forming apparatus further comprises:

a belt, the belt being contactable with the photosensitive drum in a state the first process cartridge is located in the inner position and the cover is located in the cover-closed position, and wherein in a case the cover moves from the cover-closed position to the cover-opened position in a state the first process cartridge is located in the inner position, the process cartridge guide moves in a direction in which the photosensitive drum separates from the belt in conjunction with the movement of the cover.

* * * * *